US012655690B2

(12) United States Patent
Vemuri et al.

(10) Patent No.: US 12,655,690 B2
(45) Date of Patent: Jun. 16, 2026

(54) METHOD TO ISOLATE PRESSURE ON A MULTILATERAL ORIENTATION ASSEMBLY WITH A REDUCTION IN TRIPS

(71) Applicant: Halliburton Energy Services, Inc., Houston, TX (US)

(72) Inventors: Srinivasa Prasanna Vemuri, Carrollton, TX (US); Matthew James Kelsey, Spring, TX (US); Eulalio De Jesus Rosas Fermin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/962,778

(22) Filed: Oct. 10, 2022

(65) Prior Publication Data

US 2023/0110168 A1 Apr. 13, 2023

Related U.S. Application Data

(60) Provisional application No. 63/255,049, filed on Oct. 13, 2021.

(51) Int. Cl.

| | |
|---|---|
| ***E21B 7/06*** | (2006.01) |
| ***E21B 23/01*** | (2006.01) |
| ***E21B 31/00*** | (2006.01) |
| ***E21B 33/12*** | (2006.01) |
| ***E21B 33/128*** | (2006.01) |

(52) U.S. Cl.

CPC ..... *E21B 7/061* (2013.01); *E21B 23/01* (2013.01); *E21B 31/002* (2013.01); *E21B 33/12* (2013.01); *E21B 33/128* (2013.01)

(58) Field of Classification Search

CPC ..... E21B 7/061; E21B 23/01; E21B 31/002; E21B 33/12; E21B 33/128

See application file for complete search history.

(56) References Cited

U.S. PATENT DOCUMENTS

| | | | | | |
|---|---|---|---|---|---|
| 4,153,109 | A * | 5/1979 | Szescila | E21B 7/061 | 166/123 |
| 5,193,620 | A * | 3/1993 | Braddick | E21B 33/1292 | 175/81 |
| 5,335,737 | A * | 8/1994 | Baugh | E21B 7/061 | 175/81 |
| 5,398,754 | A | 3/1995 | Dinhole | | |
| 5,427,177 | A * | 6/1995 | Jordan, Jr. | E21B 7/061 | 166/50 |
| 5,615,740 | A * | 4/1997 | Comeau | E21B 17/00 | 166/380 |
| 5,649,595 | A | 7/1997 | Davis et al. | | |
| 5,680,901 | A * | 10/1997 | Gardes | E21B 7/061 | 166/50 |
| 5,692,564 | A * | 12/1997 | Brooks | E21B 23/02 | 166/185 |

(Continued)

*Primary Examiner* — Steven A Macdonald

(74) *Attorney, Agent, or Firm* — Scott Richardson; Parker Justiss. P.C.

(57) ABSTRACT

Provided, in one aspect, is an anchoring subassembly, a well system, and a method for forming a well system. The anchoring subassembly, in at least one aspect, includes an orienting receptacle section, a sealing section coupled proximate a downhole end of the orienting receptacle section, and a latching element section coupled proximate a downhole end of the sealing section.

20 Claims, 25 Drawing Sheets

(56) References Cited

U.S. PATENT DOCUMENTS 6,012,527 A * 1/2000 Nitis ..... E21B 29/06 166/50
6,089,319 A * 7/2000 Singleton ..... E21B 23/01 166/208
6,123,150 A 9/2000 McGarian et al.
6,192,748 B1 * 2/2001 Miller ..... E21B 7/061 73/152.43
6,283,208 B1 * 9/2001 George ..... E21B 23/12 166/255.2
6,761,217 B1 * 7/2004 McGarian ..... E21B 23/01 175/81
6,786,282 B2 * 9/2004 Begg ..... E21B 7/061 166/50
8,286,708 B2 10/2012 Assal et al.
8,820,437 B2 9/2014 Ervin et al.
10,006,264 B2 6/2018 Glaser et al.
10,704,329 B2 7/2020 Campbell et al.
10,934,780 B2 3/2021 Pray et al.
11,352,849 B2 * 6/2022 Hepburn ..... E21B 41/0035
2002/0023757 A1 * 2/2002 George ..... E21B 47/09 166/380
2003/0010497 A1 * 1/2003 Begg ..... E21B 7/061 166/117.6
2003/0192717 A1 * 10/2003 Smith ..... E21B 43/103 166/50
2007/0227745 A1 10/2007 Roberts et al.
2010/0294512 A1 * 11/2010 Assal ..... E21B 7/061 166/384
2012/0267093 A1 * 10/2012 Zimmerman ..... E21B 41/0042 166/55
2014/0332205 A1 * 11/2014 Harrington ..... E21B 21/103 166/237
2016/0145956 A1 * 5/2016 Dahl ..... E21B 23/12 166/117.6
2017/0258701 A1 9/2017 Molenda et al.
2018/0187519 A1 * 7/2018 Rodriguez ..... E21B 47/07
2018/0258701 A1 * 9/2018 Saurer ..... E21B 47/024
2018/0274300 A1 9/2018 Vemuri et al.
2018/0283140 A1 10/2018 Steele
2018/0335674 A1 11/2018 Shibazaki
2019/0040719 A1 * 2/2019 Rodriguez ..... E21B 41/0042
2019/0316435 A1 10/2019 Taylor, Jr.

* cited by examiner 300
305
800
220
224

380
810
230
232

METHOD TO ISOLATE PRESSURE ON A MULTILATERAL ORIENTATION ASSEMBLY WITH A REDUCTION IN TRIPS

CROSS-REFERENCE TO RELATED APPLICATION

This application claims the benefit of U.S. Provisional Application Ser. No. 63/255,049, filed on Oct. 13, 2021, entitled "METHOD TO ISOLATE PRESSURE ON A LEVEL 4 MULTILATERAL WASHOVER WHIPSTOCK WITH A REDUCTION IN TRIPS," commonly assigned with this application and incorporated herein by reference in its entirety.

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section) with a running tool. The deflector assemblies are often laterally and rotationally fixed within the main wellbore using a wellbore anchor, and then used to create an opening in the casing.

BRIEF DESCRIPTION

Figure 1:
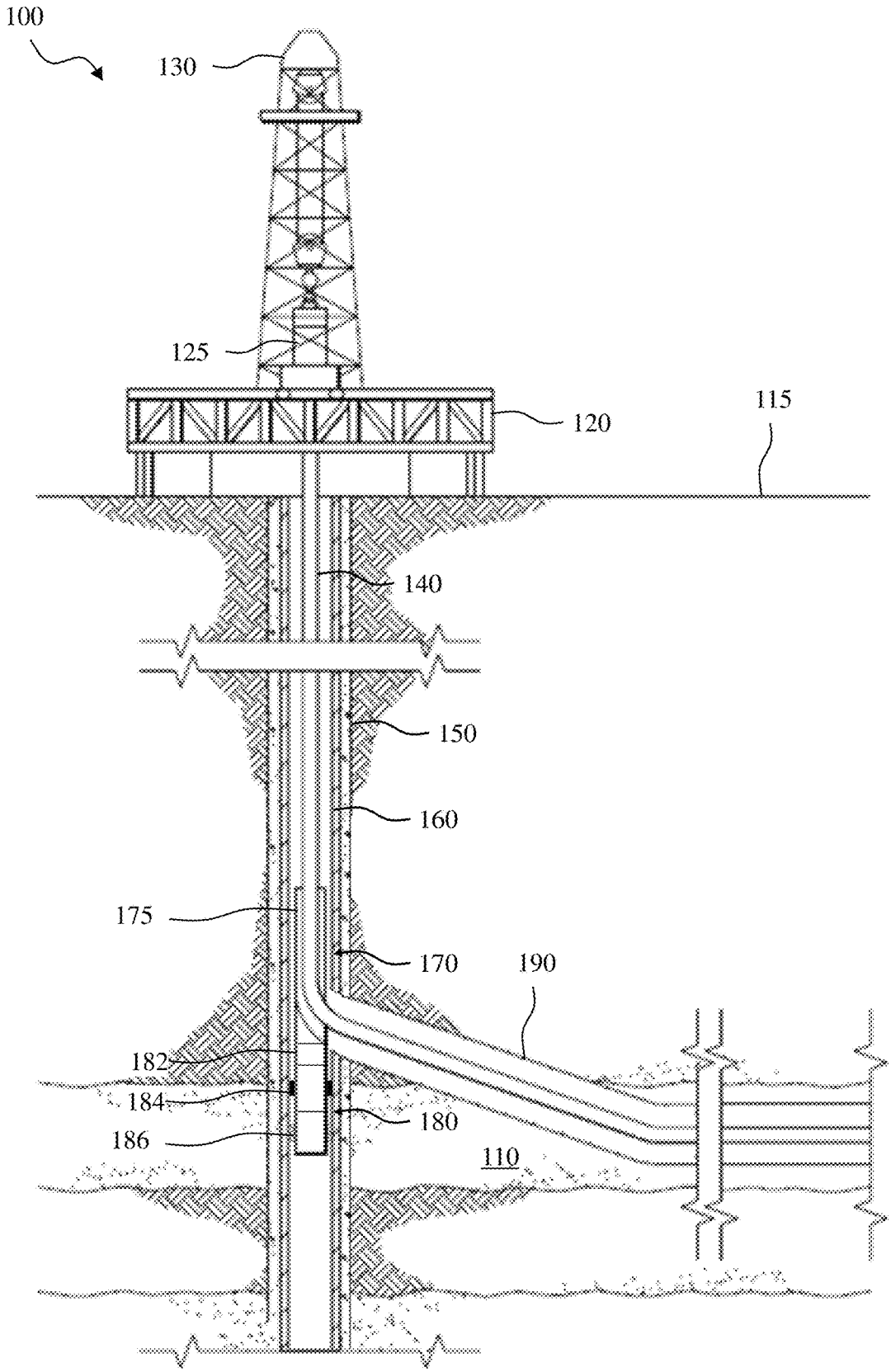
Figure 2:
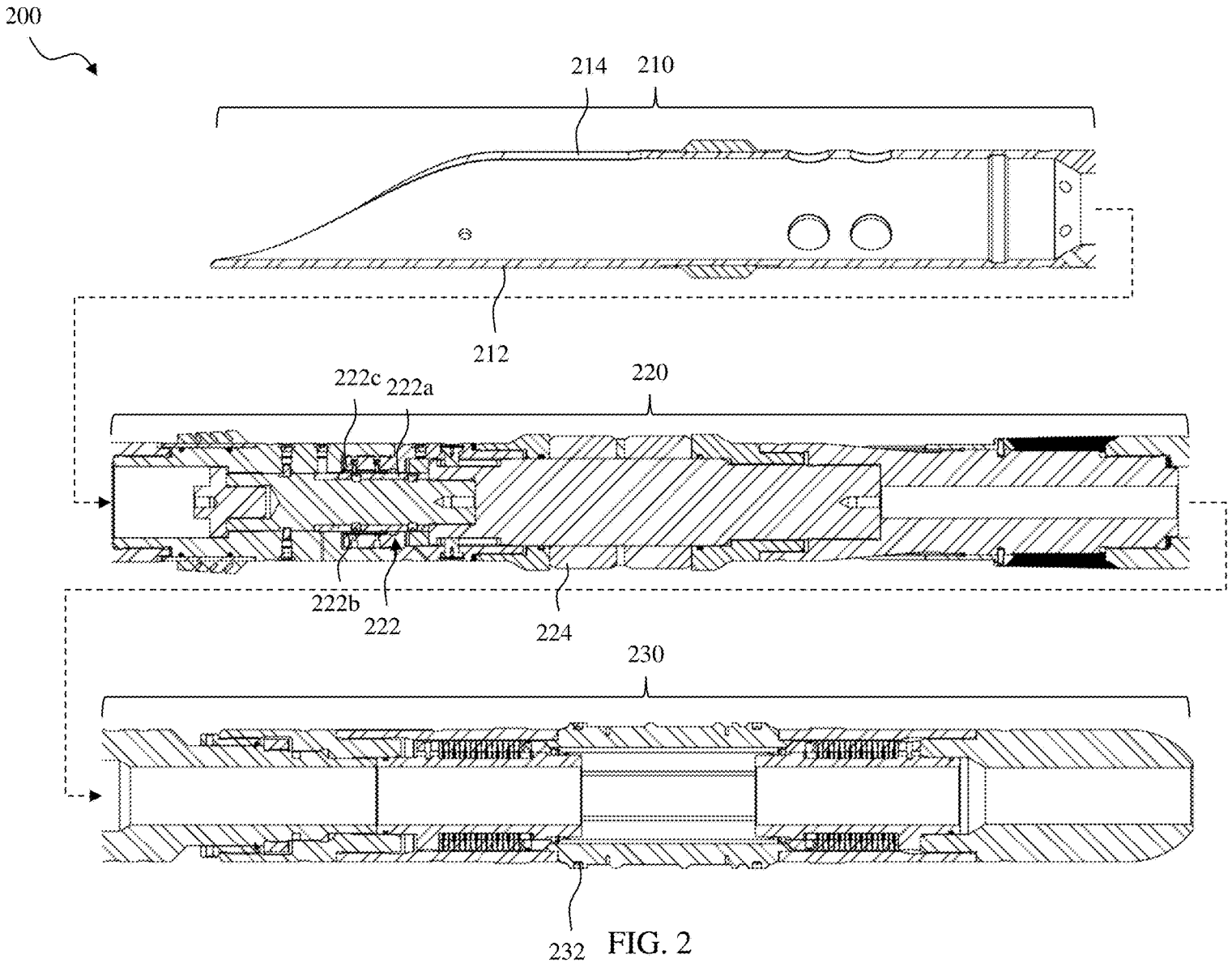

Reference is now made to the following descriptions taken in conjunction with the accompanying drawings, in which:

FIG. 1 illustrates a schematic view of a well system designed, manufactured and operated according to one or more embodiments disclosed herein;

FIG. 2 illustrates one embodiment of an anchoring subassembly designed and manufactured according to one or more embodiments of the disclosure; and FIGS. 3 through 12C illustrate one embodiment for deploying, setting, using, washing over, and retrieving a whipstock assembly including an anchoring subassembly, both of which are designed and manufactured according to one or more embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The disclosure describes a new method for deploying, setting, and retrieving one or more features of a whipstock assembly, as might be used to form a lateral wellbore from a main wellbore. In at least one embodiment, the whipstock assembly includes an anchoring subassembly, the anchoring subassembly including an orienting receptacle section, a sealing section, and a latching element section. In accordance with one embodiment of the disclosure, the orienting receptacle section, along with a collet and one or more orienting keys, may be used to land and positioned a guided milling assembly within the casing, the guided milling assembly ultimately being used to generate a pocket in the casing. In accordance with one other embodiment of the disclosure, the orienting receptacle section, along with a collet and one or more orienting keys, may be used to land and positioned a whipstock element section of the whipstock assembly within the casing, the whipstock element section ultimately being used to form a lateral wellbore off of the main wellbore, and cement a multilateral junction between the two.

In at least one embodiment, the sealing section may employ any known or hereafter sealing elements capable of setting and/or sealing the sealing section. For example, in at least one embodiment, the sealing elements are polymer sealing elements set with a mechanical axial load. In yet another embodiment the sealing elements are set with a pressure differential, and may or may not comprise a different material than a polymer. Ultimately, unless otherwise required, the present disclosure is not limited to any specific sealing elements.

Notwithstanding the foregoing, in at least one embodiment, the sealing section includes one or more different relief features to deal with excess stored energy in the isolation element of the sealing section. For example, the sealing section can hold the isolation element in its set position (e.g., fully radially expanded state) if the set force and/or setting stroke is proper, but if the set force is too big and/or the isolation element is over set (e.g., there is excess stored energy in the isolation element), the one or more different relief features may allow the isolation element to relax (e.g., self-relax) to a designed value (e.g., to a relaxed radially expanded state) while holding pressure. In at least one embodiment, the one or more different relief features include, without limitation: adding a profile to prevent a retaining screw from prematurely shearing due to the excess stored energy in the isolation element (e.g., created due to the oversetting of the isolation element); adding one or more holding shear features to be self-sheared when excess stored energy exists in the isolation element, the one or more holding shear features relaxing the isolation element to an expected value, while protecting the latch mechanism that holds the features in place; and adding a self-relaxing function that can ensure that the isolation element may be unset by a defined pulling force, thereby preventing swabbing that would occur if the isolation element were pulled out of hole with its isolation element in the expanded state.

The present disclosure also provides, in at least one other embodiment, a new method for retrieving one or more portions of an anchoring subassembly using a washover assembly. In at least one embodiment, the washover assembly may be used to washover and retrieve an orienting receptacle section of the anchoring sub assembly. In yet another embodiment, the washover assembly may be used to washover and retrieve a sealing section of the anchoring subassembly. In even yet another embodiment, the washover assembly may be used to washover and retrieve a latching element section of the anchoring subassembly. In at least one embodiment, after completing and cementing a multilateral junction (e.g., Level 4 multilateral junction), the resulting transition joint, and one or more portions of the whipstock assembly (e.g., including the whipstock element section, orienting receptacle section, sealing section and/or anchoring section), are milled over and are swallowed by the washover assembly. As the washover assembly mills the sealing section of the anchoring subassembly, any difficulties with the removal of the sealing section, including resulting swabbing effects, are eliminated. Similarly, in one or more embodiments wherein the latching element section may be stuck, the washover assembly may mill the latching element section, eliminating any difficulties with the removal of the latching element section. After the entire whipstock assembly including the whipstock element section and anchoring subassembly are retrieved (e.g., in one trip), the main wellbore may be left with full ID access.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as an anchoring subassembly 180 coupled to a downhole end thereof. The anchoring subassembly 180, in one or more embodiments, includes an orienting receptacle section 182, a sealing section 184, and a latching element section 186. In at least one embodiment, the latching element section 186 axially, and optionally rotationally, fixes the whipstock assembly 170 within the casing string 160. The sealing section 184, in at least one embodiment, seals (e.g., provides a pressure tight seal) an annulus between the whipstock assembly 170 and the casing string 160. The orienting receptacle section 182, in one or more embodiments, along with a collet and one or more orienting keys, may be used to land and positioned a guided milling assembly and/or the whipstock element section 175 within the casing string 160.

The elements of the whipstock assembly 170 may be positioned within the main wellbore 150 in one or more separate steps. For example, in at least one embodiment, the anchoring sub assembly 180, including the orienting receptacle section 182, sealing section 184 and the latching element section 186 are run in hole first, and then set within the casing string 160. Thereafter, the sealing section 184 may be pressure tested,. Thereafter, the whipstock element section 175 may be run in hole and coupled to the anchoring subassembly 180, for example using the orienting receptacle section 182. What may result is the whipstock assembly 170 illustrated in FIG. 1.

Turning now to FIG. 2, illustrated is one embodiment of an anchoring subassembly 200 designed and manufactured according to one or more embodiments of the disclosure. The anchoring subassembly 200, in the illustrated embodiment of FIG. 2, includes an orienting receptacle section 210, a sealing section 220, and a latching element section 230. In at least the embodiment of FIG. 2, the orienting receptacle section 210, includes an orienting receptacle 212 (e.g., muleshoe, for example, having an axial orientation slot 214 configured to engage with an orientation feature of a related downhole tool). Additionally, at least in the embodiment of FIG. 2, the sealing section 220 includes internal slips with a ratcheting mechanism 222, as well as an isolation element 224 (e.g., mechanically set isolation element, hydraulically set isolation device, etc.), and the latching element section 230 includes a latching feature 232. The ratcheting mechanism 222, in one embodiment, includes a ratchet sleeve **222*a*, a mating lock ring 222*b* positioned radially about the ratchet sleeve 222*a*, and a shear ring 222*c*. The isolation element 224, in the illustrated embodiment, is configured to move between a radially retracted state and a radially expanded state. The latching feature 232**, in the illustrated embodiment, is configured to engage with a profile (e.g., depth and orienting coupling profile) in a casing string (not shown).

Figure 3:
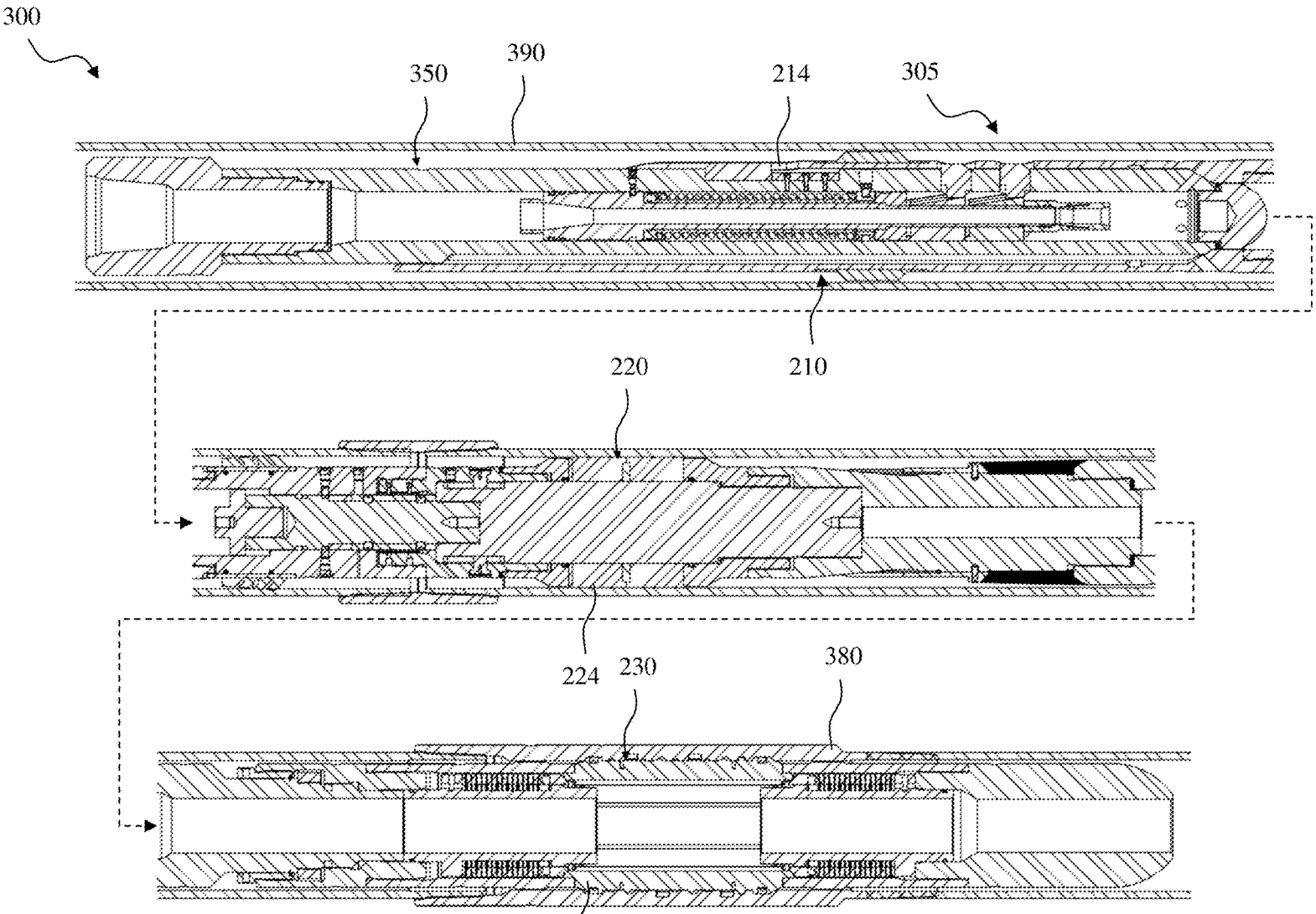

Turning to FIGS. 3 through 11*b*, illustrated is one embodiment for deploying, setting, using and retrieving a whipstock assembly 300 including an anchoring subassembly 305, both of which are designed and manufactured according to one or more embodiments of the disclosure. The anchoring subassembly 305 is similar in many respects to the anchoring subassembly 200 described and illustrated with respect to FIG. 2. Accordingly, like reference numbers have been used to illustrate similar features. In the illustrated embodiment of FIG. 3, the anchoring subassembly 305 includes the orienting receptacle section 210, the sealing section 220, and the latching element section 230. Further to the embodiment of FIG. 3, the anchoring subassembly 305 is being run within a casing string 390 using a running/setting tool 350 (e.g., hydraulic running/setting tool in one embodiment). Once at depth, the latching feature 232 of the latching element section 230 will be landed into a depth and orienting coupling 380, which is installed as part of the casing string 390. Once landed, axial load may be applied to set the sealing section 220, engaging the internal slips to keep the sealing section 220, and more particularly the isolation element 224, in the set position, as shown in FIG. 3.

Figure 4:
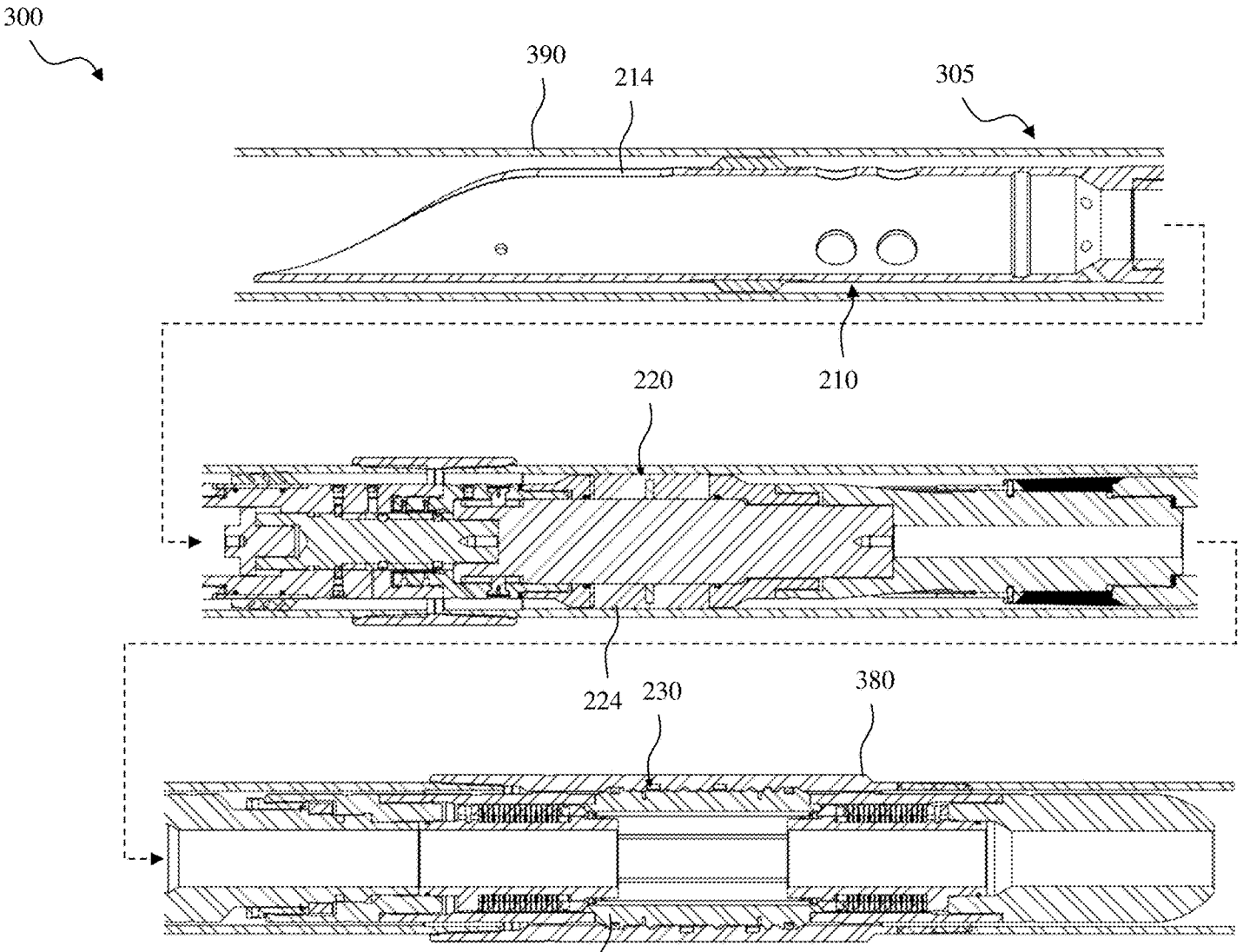

Turning to FIG. 4, illustrated is the anchoring subassembly 305 of FIG. 3 after confirming that the sealing section 220 is properly set, for example by applying pressure, and then removing the running/setting tool 350. As is clear, the anchoring subassembly 305 includes the orienting receptacle section 210, the sealing section 220, and the latching element section 230.

Figure 5A:
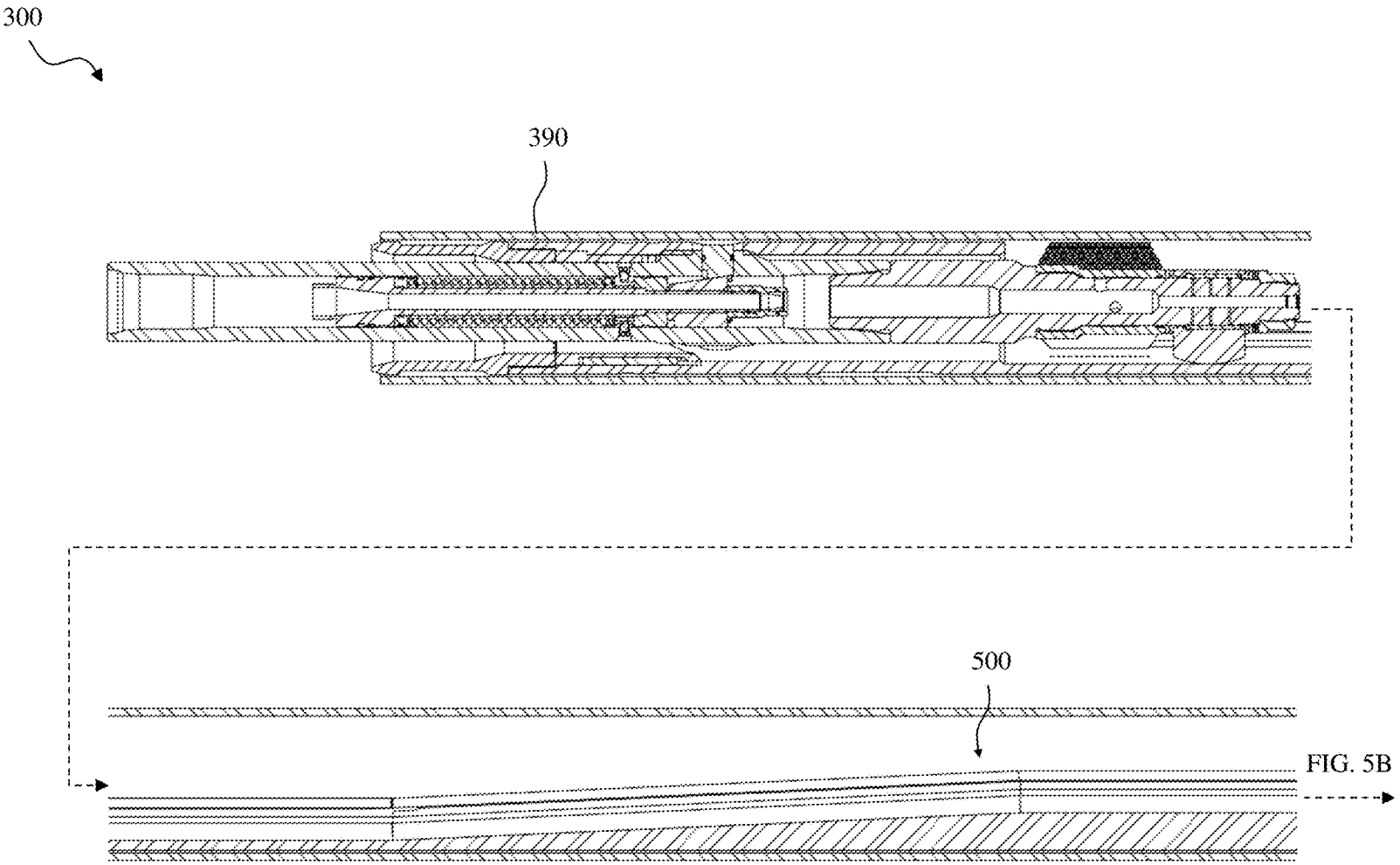
Figure 5B:
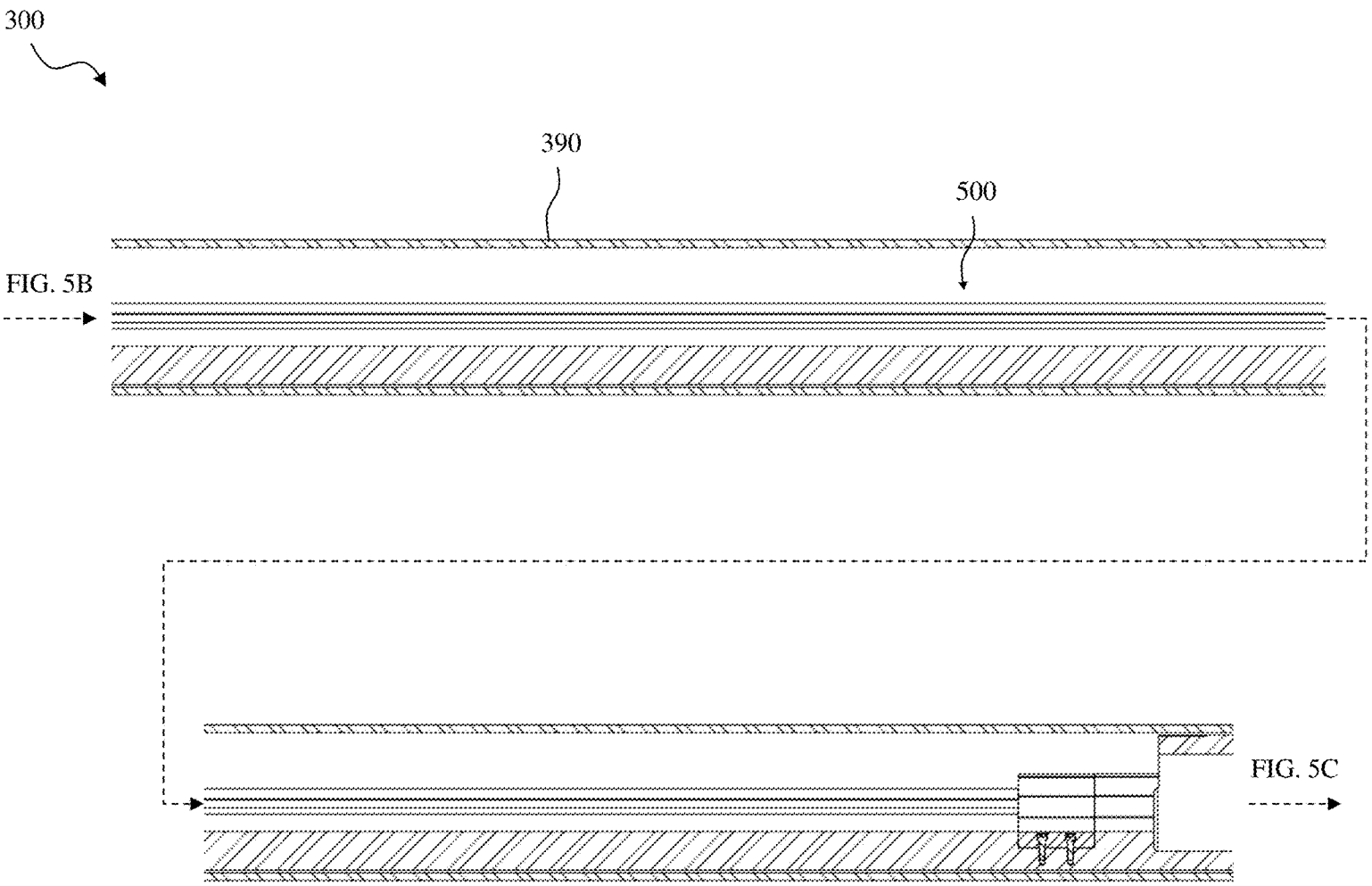
Figure 5C:
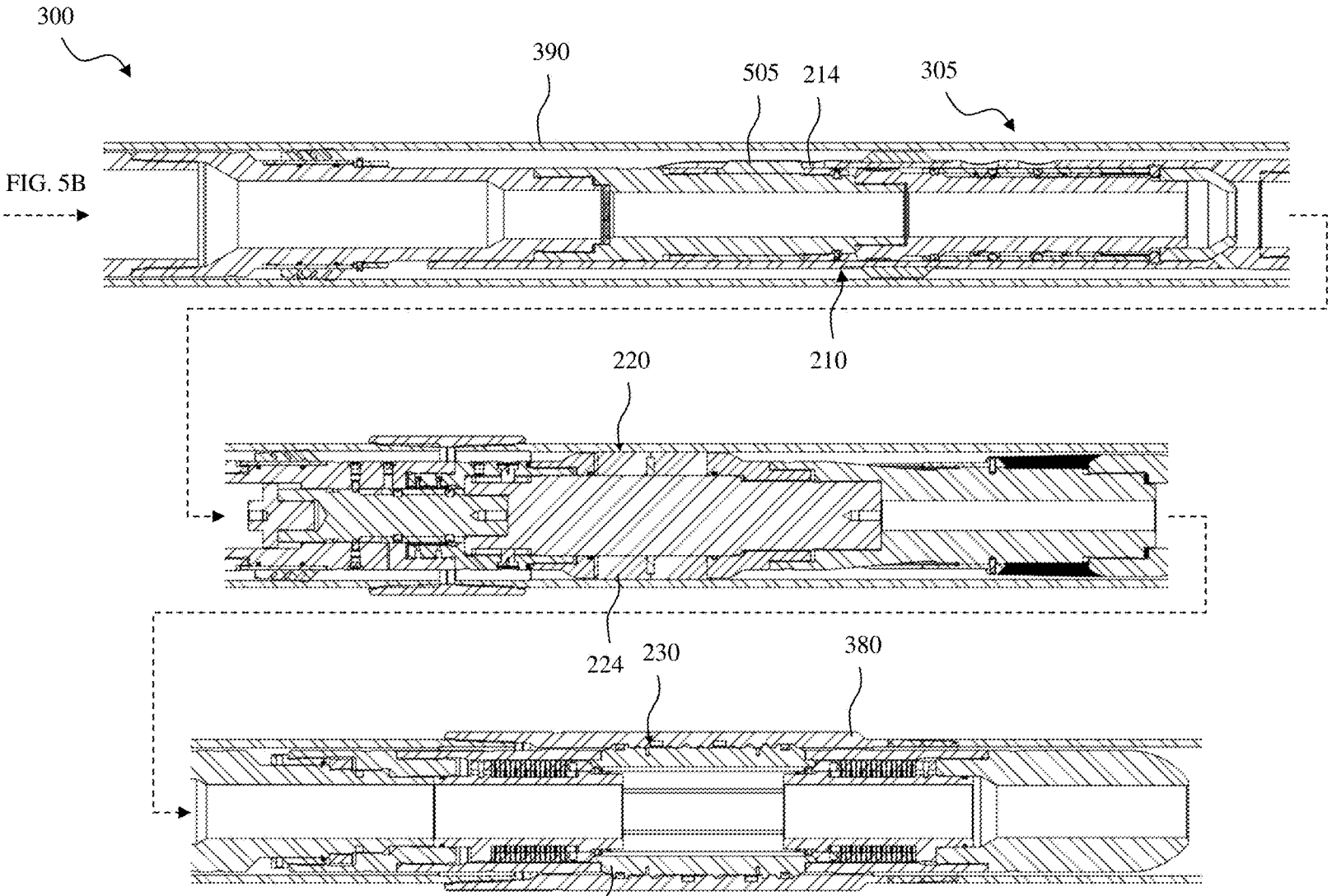

Turning to FIGS. 5A through 5C, illustrated is the anchoring subassembly 305 of FIG. 4 after coupling a guided milling assembly 500 (e.g., related downhole tool) with the anchoring subassembly 305. The guided milling assembly 500, in one or more embodiments, is configured to generate a pocket in the casing string 390. In at least one embodiment, the guided milling assembly 500 is landed into the orienting receptacle section 210 (e.g., using a collet, and orienting feature/key 505 that engages the axial orientation slot 214 of the orienting receptacle 212) as shown in FIGS. 5A and 5B. After a pocket is formed in the casing string 390, the guided milling assembly 500 is released from the orienting receptacle section 210 and removed from the casing string 390, as shown in FIG. 5C.

Figure 6A:
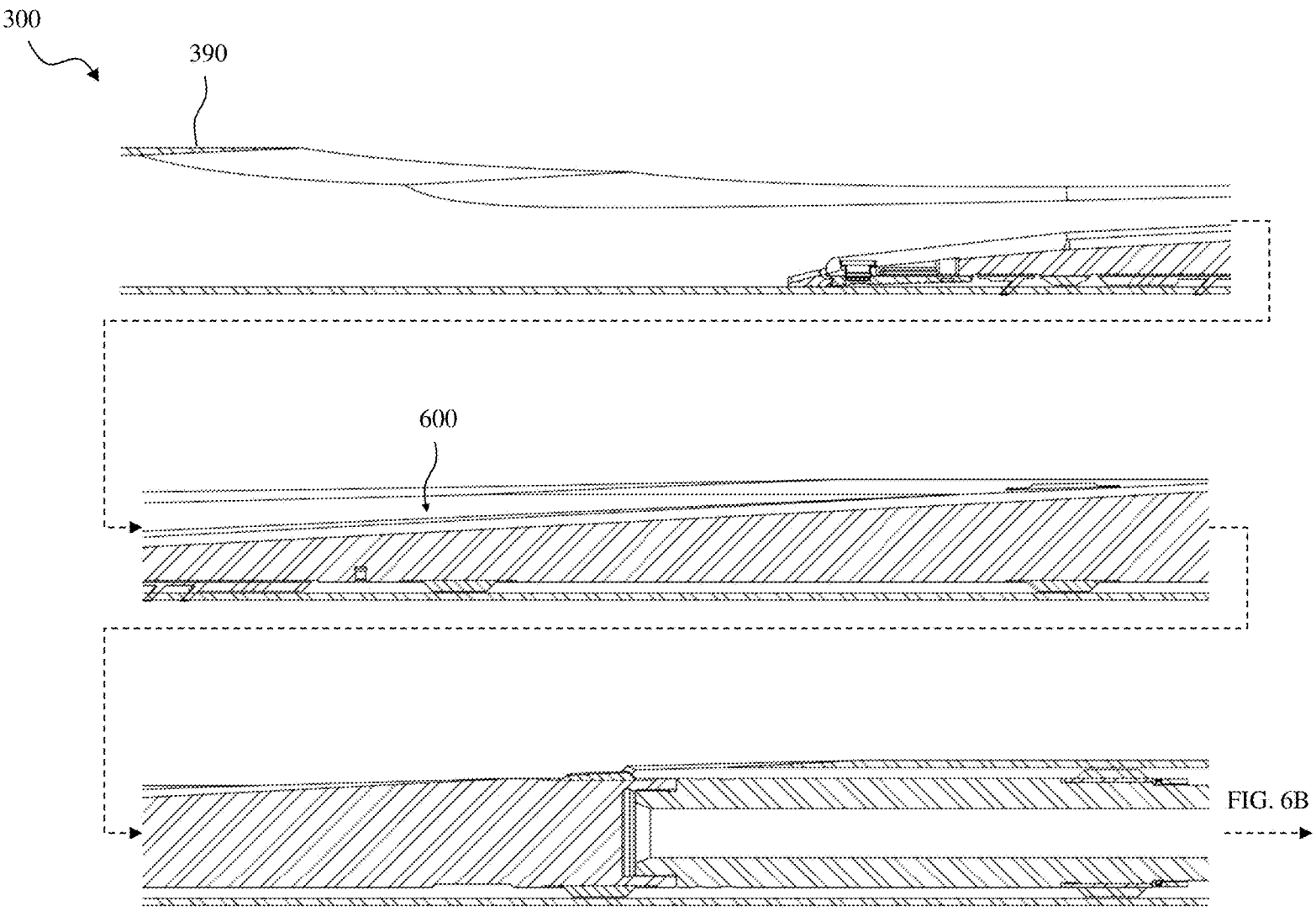
Figure 6B:
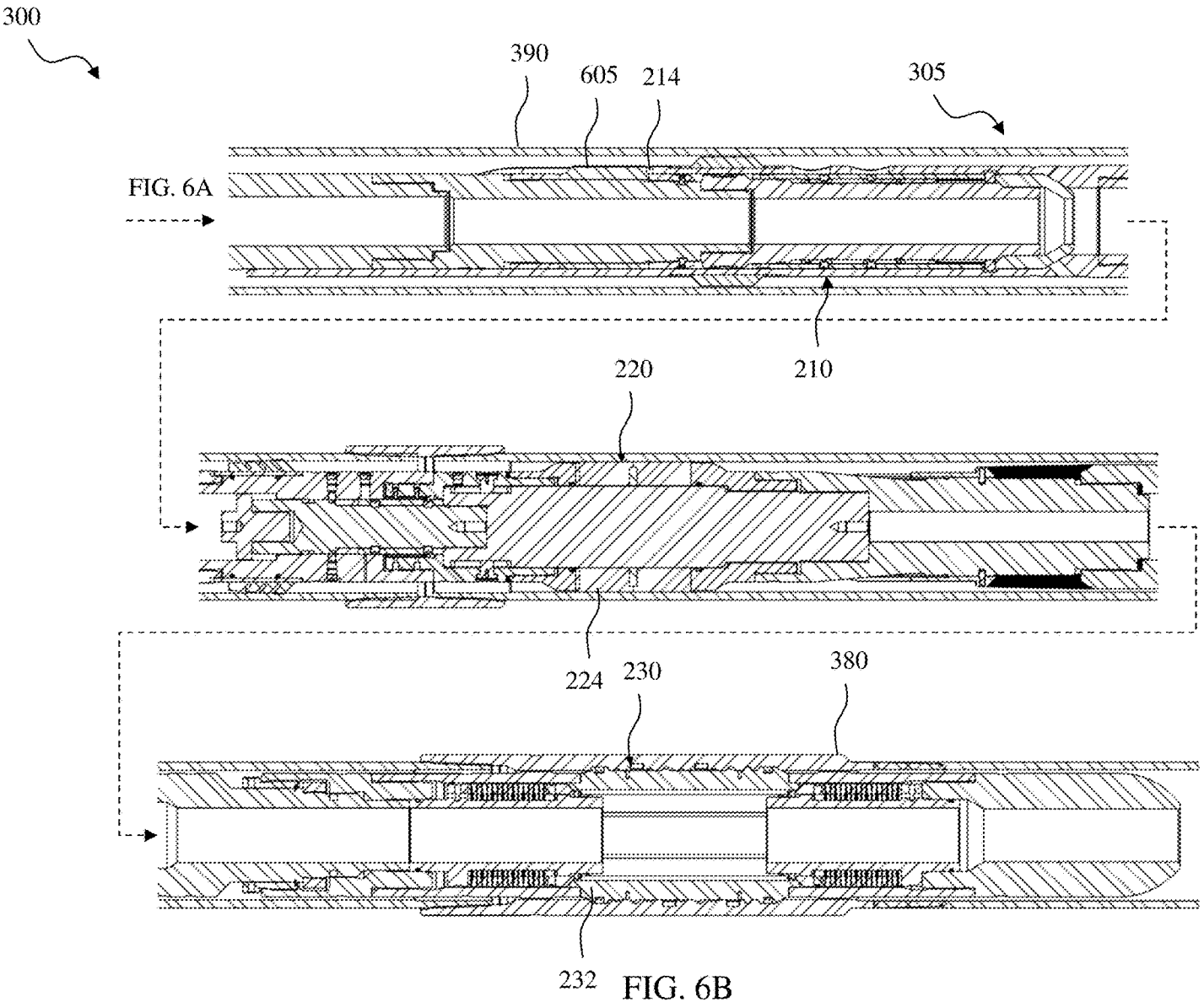

Turning to FIGS. 6A and 6B, illustrated is the anchoring subassembly 305 of FIGS. 5A and 5B after coupling a whipstock element section 600 with the anchoring subassembly 305. The whipstock element section 600, in one or more embodiments, is configured to facilitate the milling and/or formation of the lateral wellbore, as well as the cementing of the multilateral junction. The whipstock assembly 300 (e.g., including the whipstock element section 600 and anchoring subassembly 305), aided by the sealing section 220, allows for completing the lateral cementing operations without risk of cement entering the main wellbore. In at least one embodiment, the whipstock element section 600 is landed into the orienting receptacle section 210 (e.g., using a collet and orienting feature/key 605 that engages the axial orientation slot 214 of the orienting receptacle 212) as shown in FIGS. 6A and 6B.

Figure 7A:
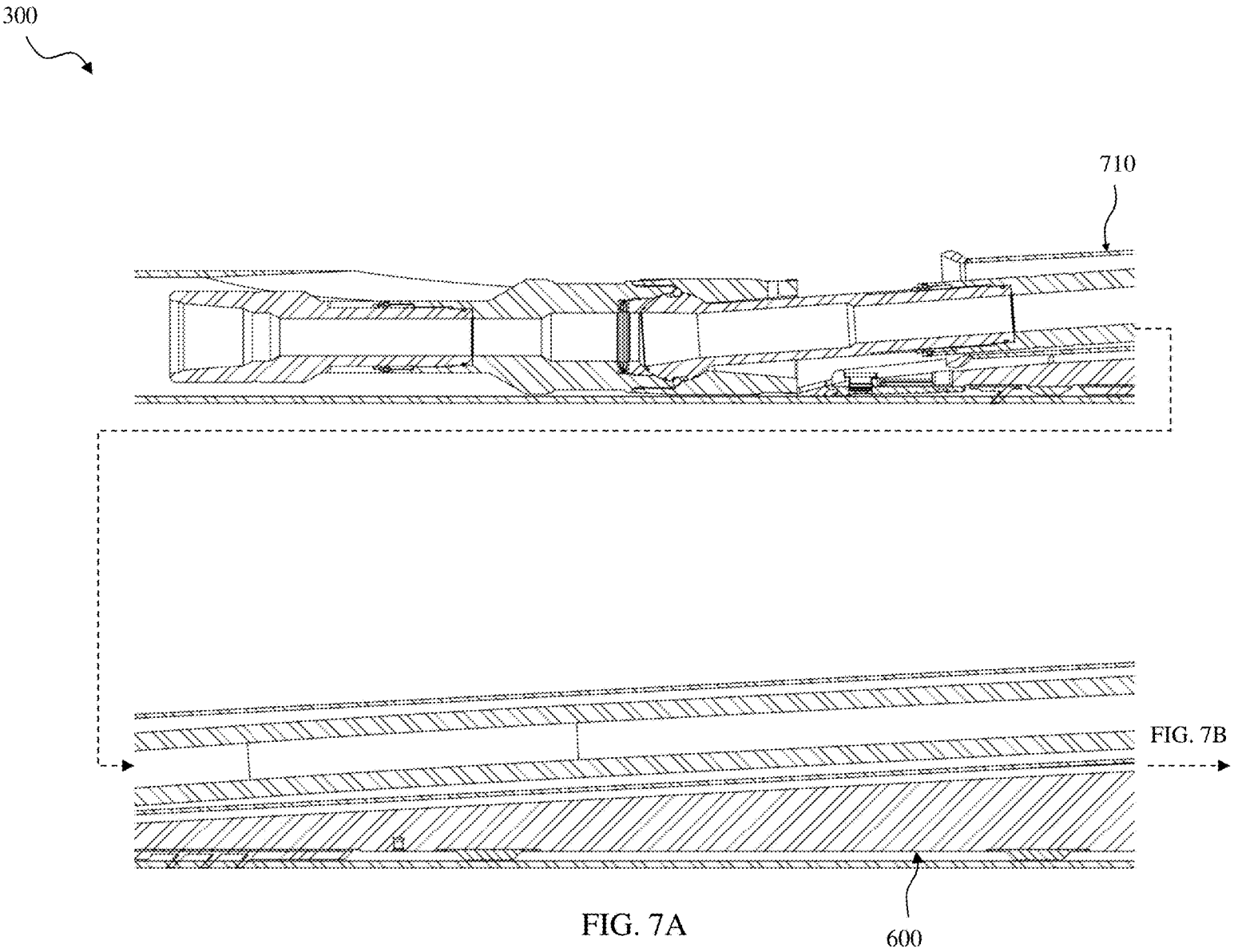
Figure 7B:
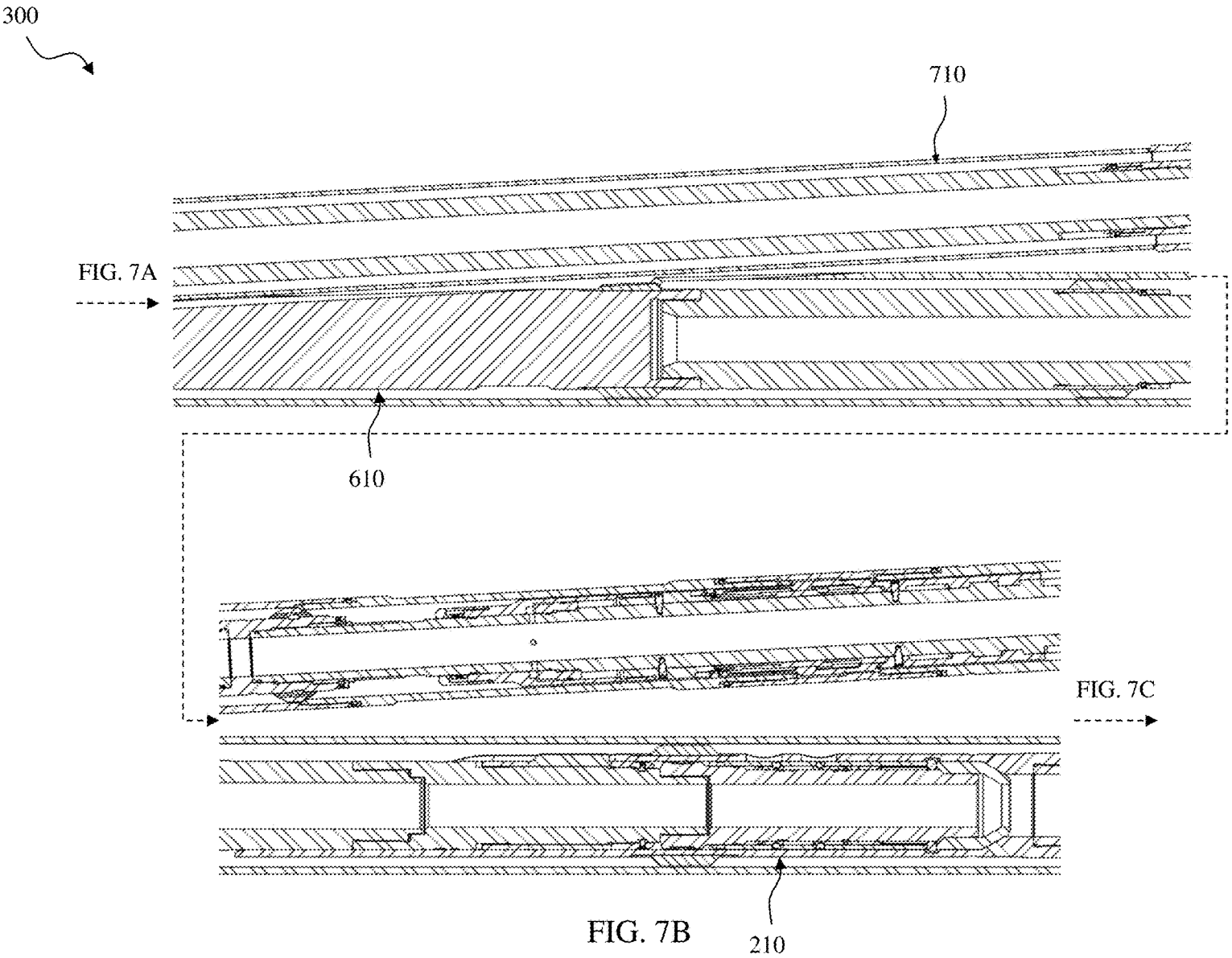
Figure 7C:
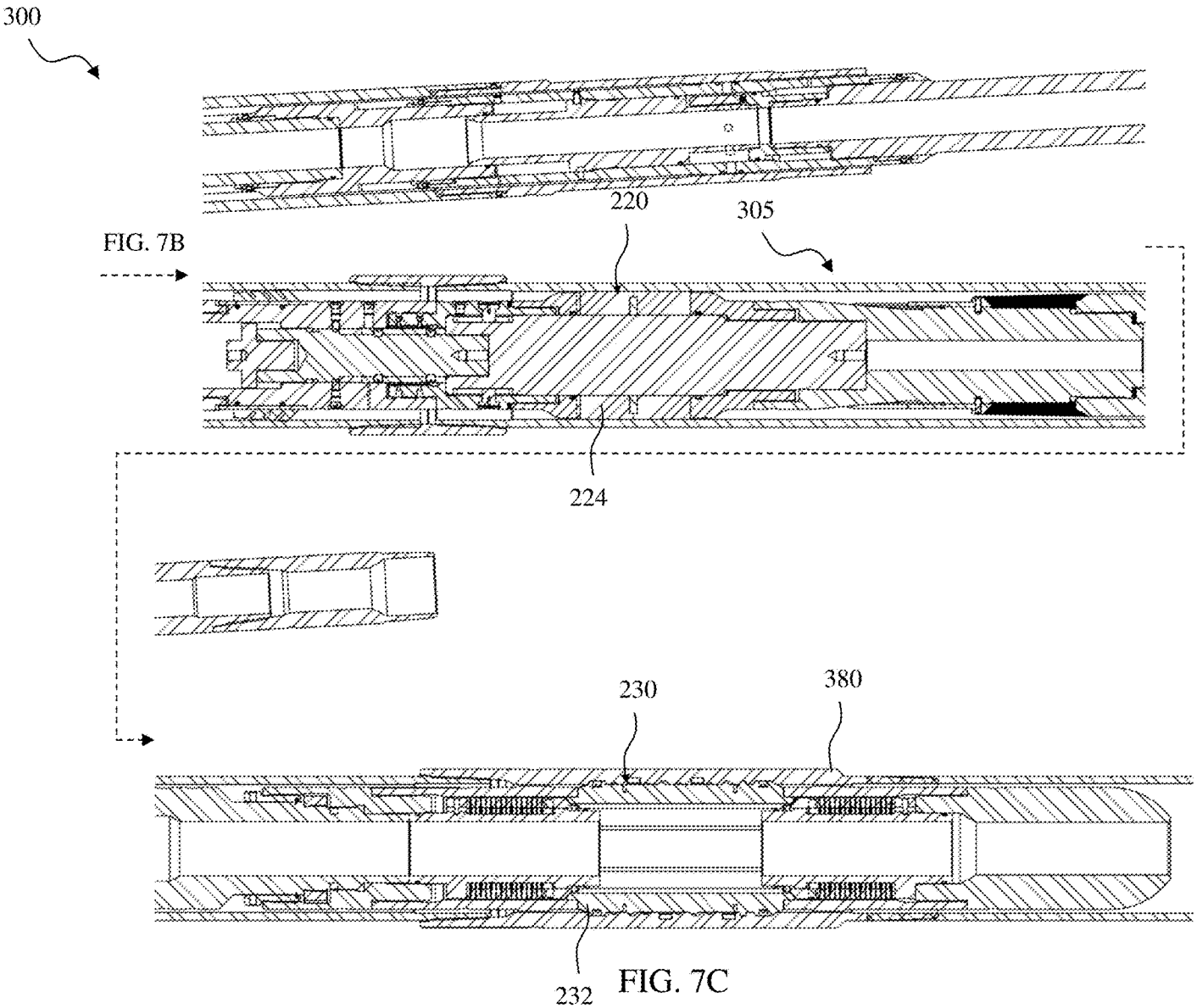

Turning to FIGS. 7A through 7C, illustrated is the whipstock assembly 300, including the whipstock element section 600 and anchoring subassembly 305 of FIGS. 6A and 6B, with a lateral liner having a transition joint 710 extending into the lateral wellbore.

Figure 8:
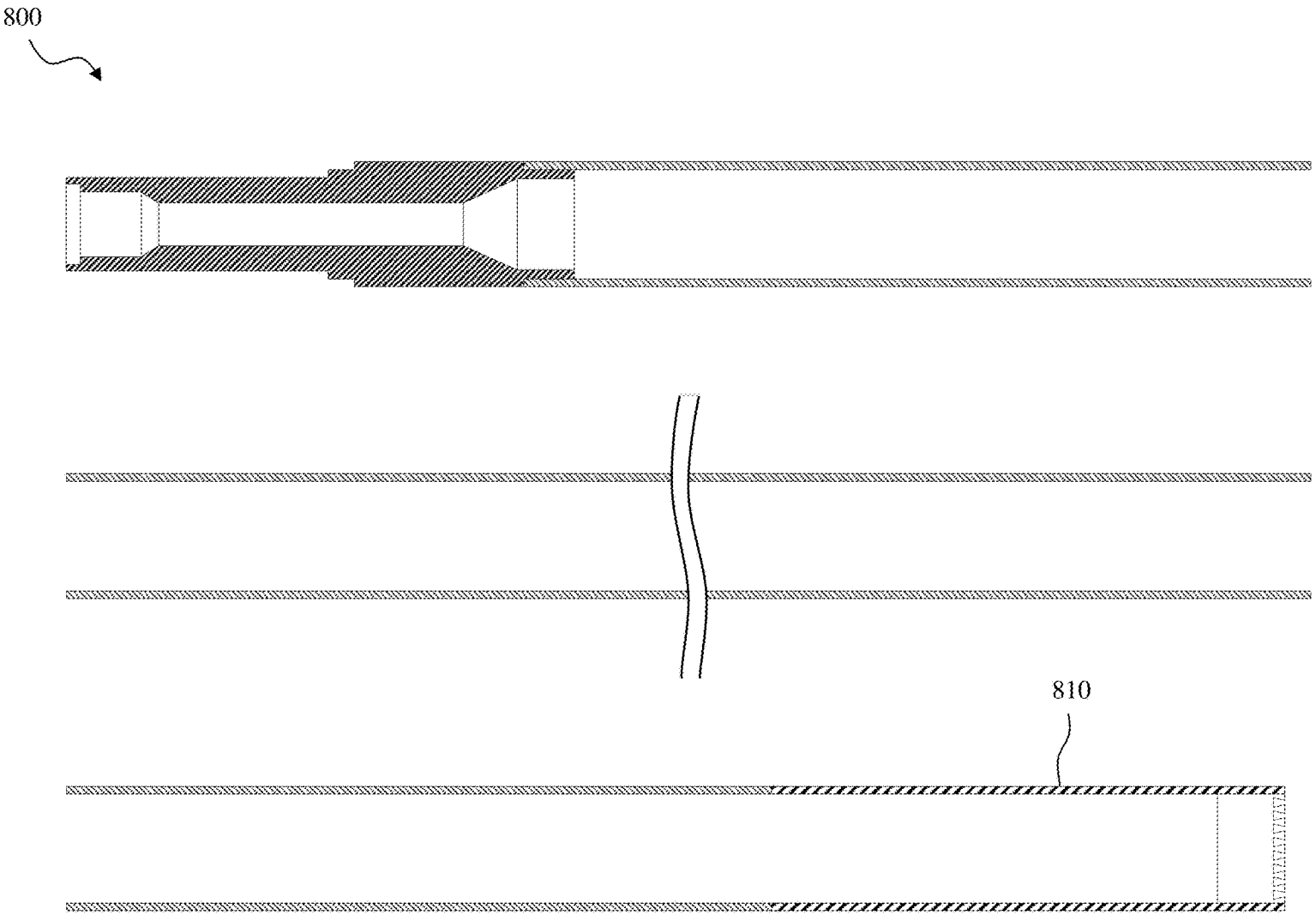

Turning briefly to FIG. 8, illustrated is a washover assembly 800 according to one or more embodiments of the disclosure. The washover assembly 800 includes removal and/or milling feature 810 at a downhole end thereof.

After completing lateral cementing (e.g., as part of Level 4 junction creation), the whipstock assembly 300 (e.g., including the whipstock element section 600 and the anchoring subassembly 305) may be removed using a washover assembly similar to the washover assembly 800 of FIG. 8. In at least one embodiment, the whipstock assembly 300 is retrieved in a single trip using the washover assembly 800. As shown in FIGS. 9A through 12B, portions of the whipstock assembly 300 (e.g., including the orienting receptacle section 210, the sealing section 220, and/or the latching element section 230) may be milled over and swallowed by the washover assembly 800, thus eliminating any swabbing or difficulties retrieving the sealing section 220 and/or latching element section 230. After the entire whipstock assembly 300, including the orienting receptacle section 210, the sealing section 220, and the latching element section 230, is retrieved (e.g., in a single trip) the main wellbore is left with full ID access.

Figure 9A:
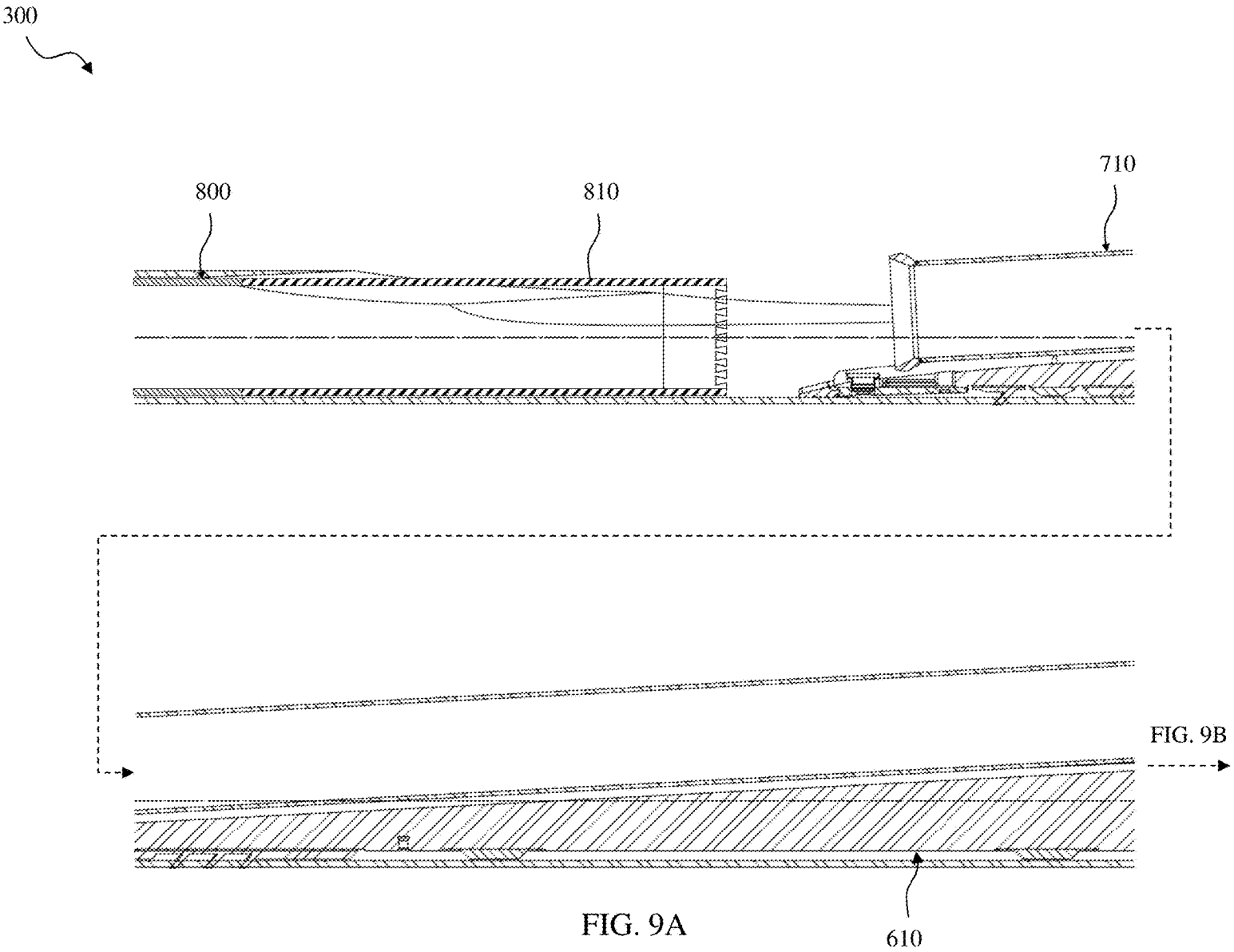
Figure 9B:
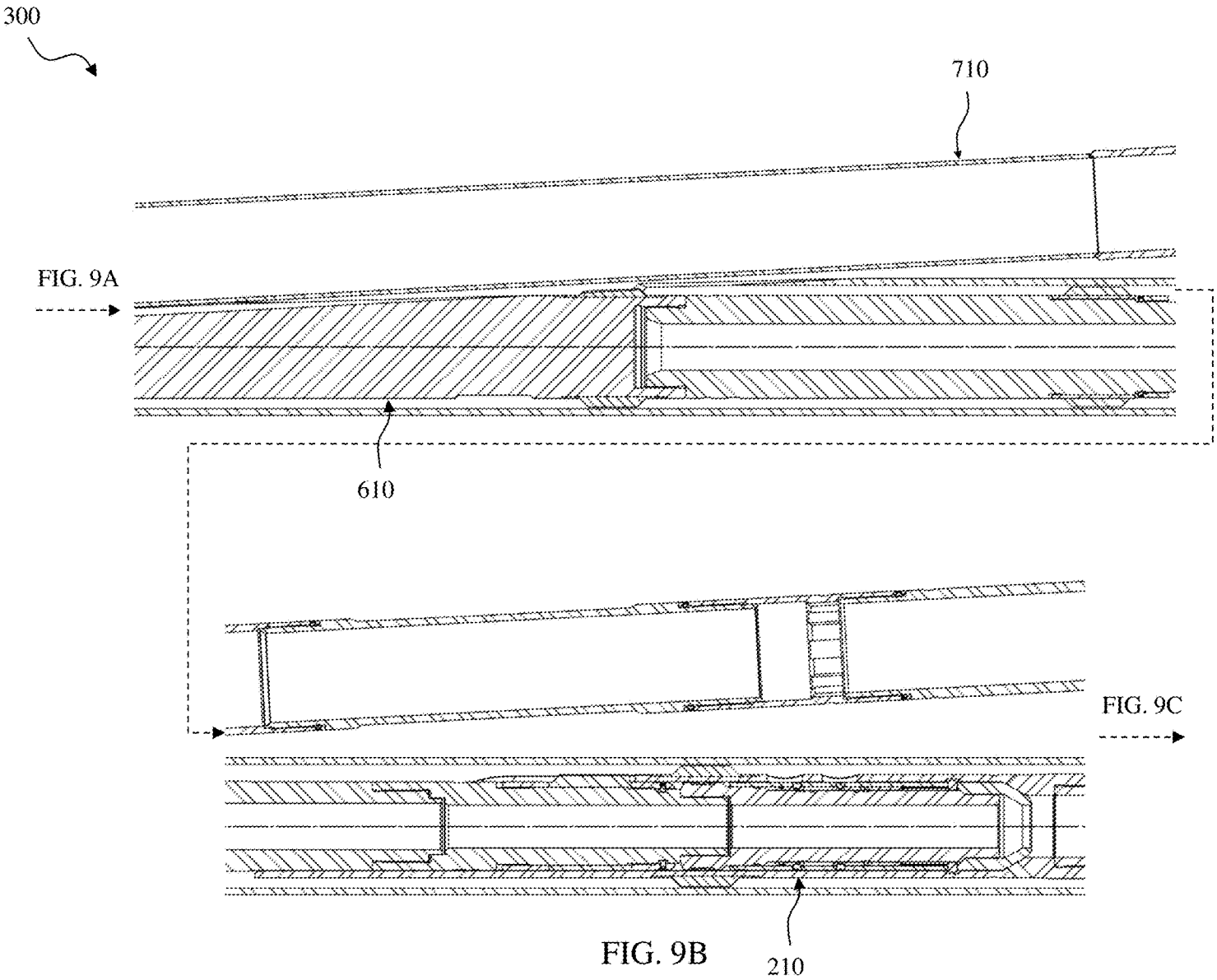
Figure 9C:
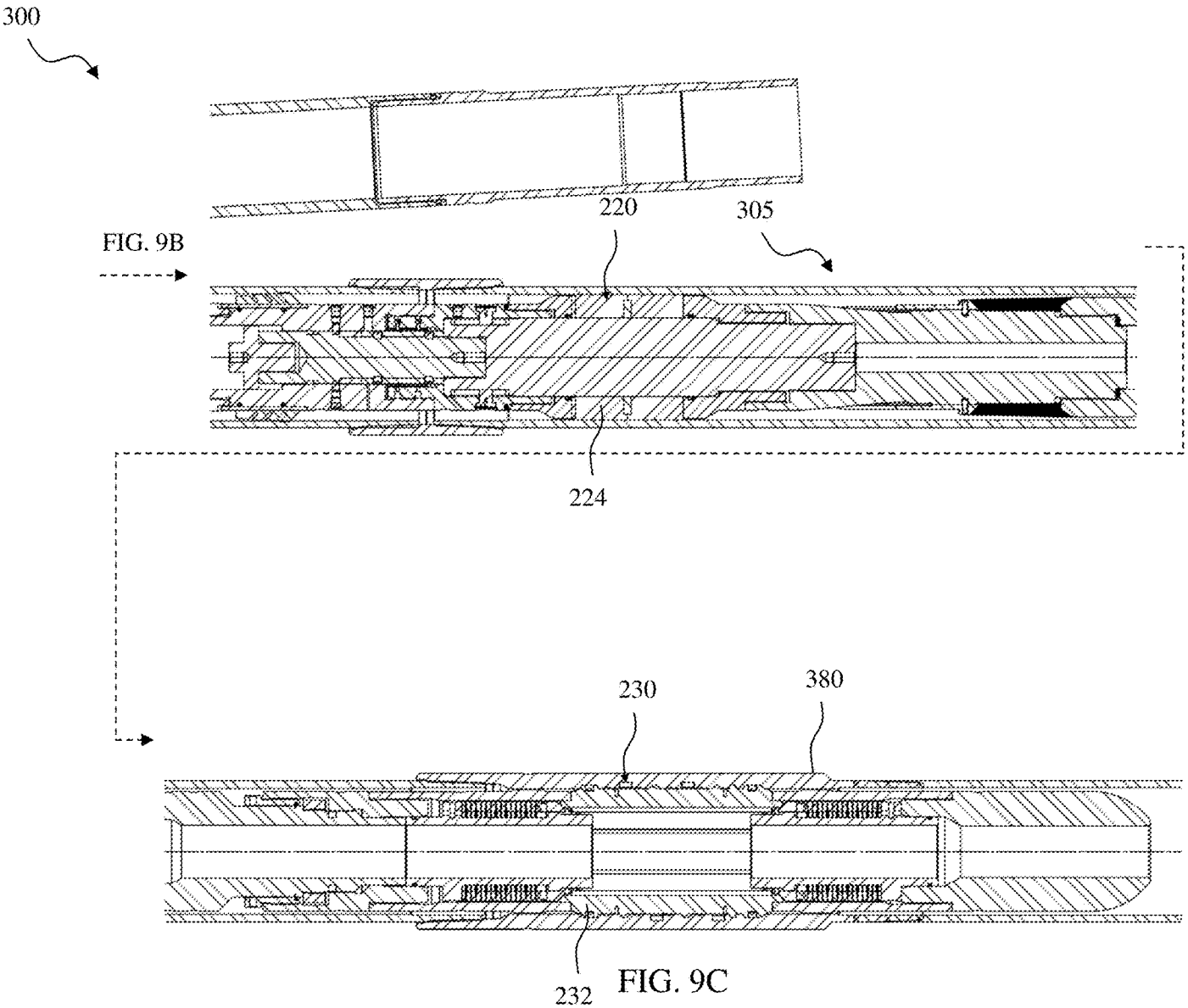
Figure 10A:
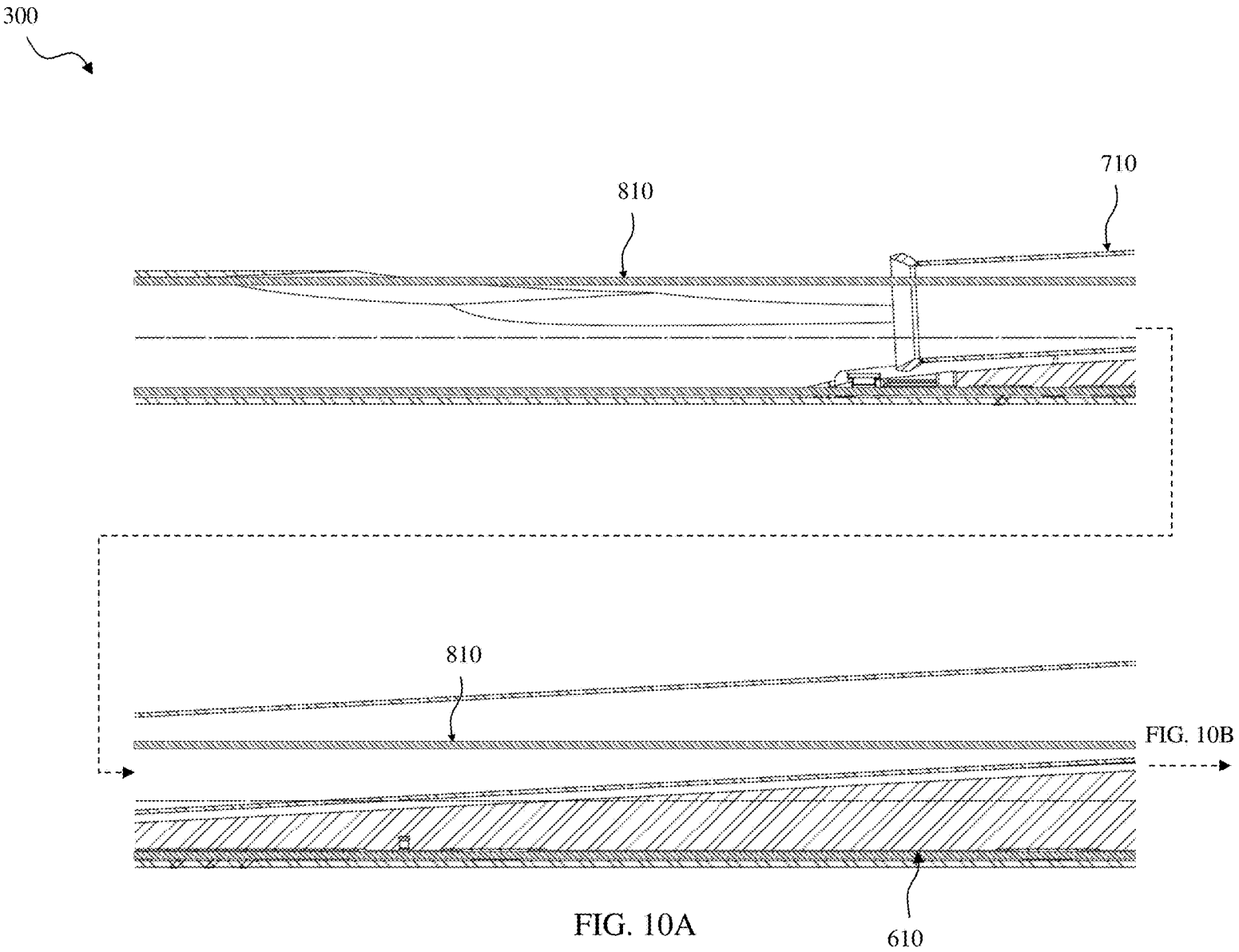
Figure 10B:
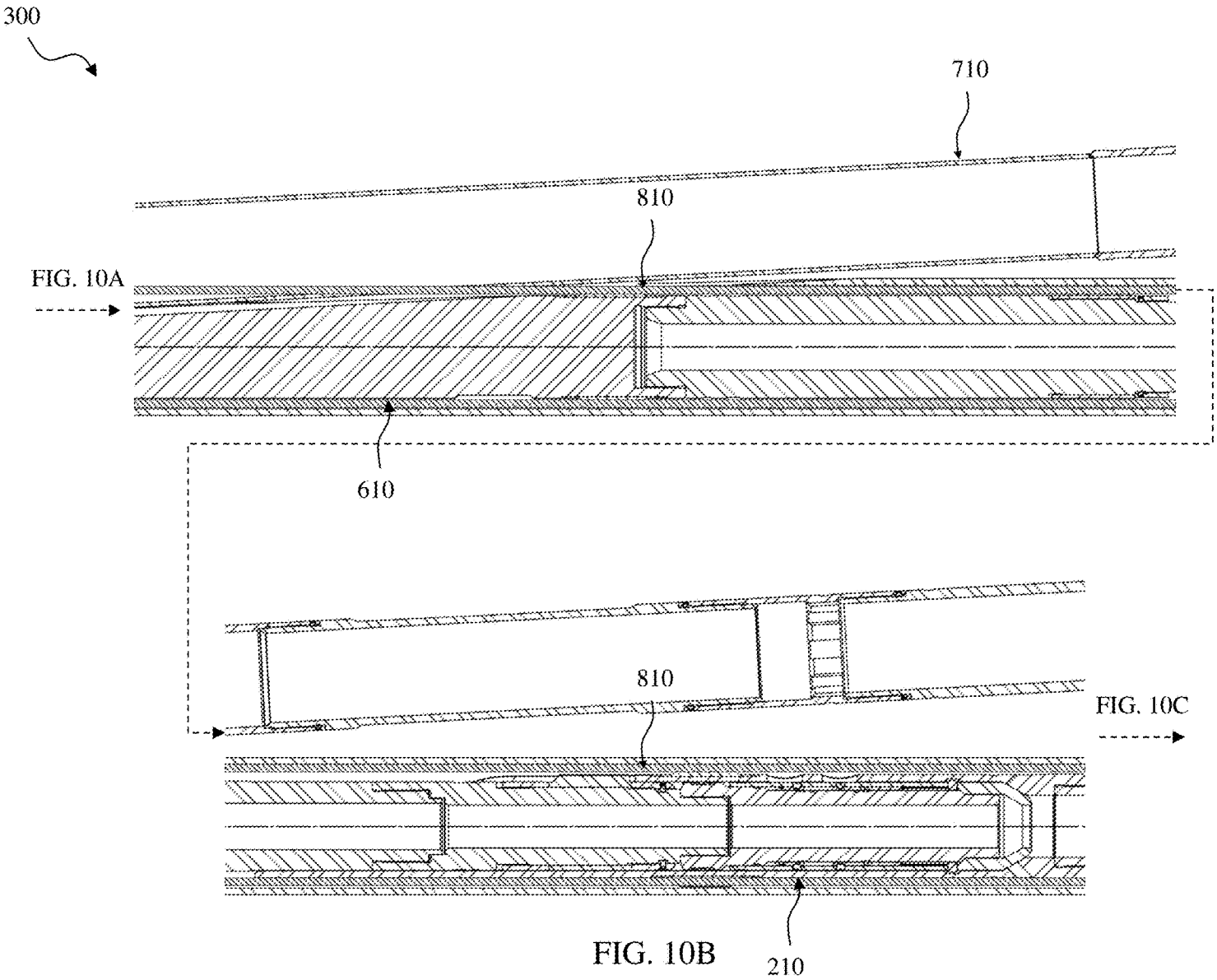
Figure 10C:
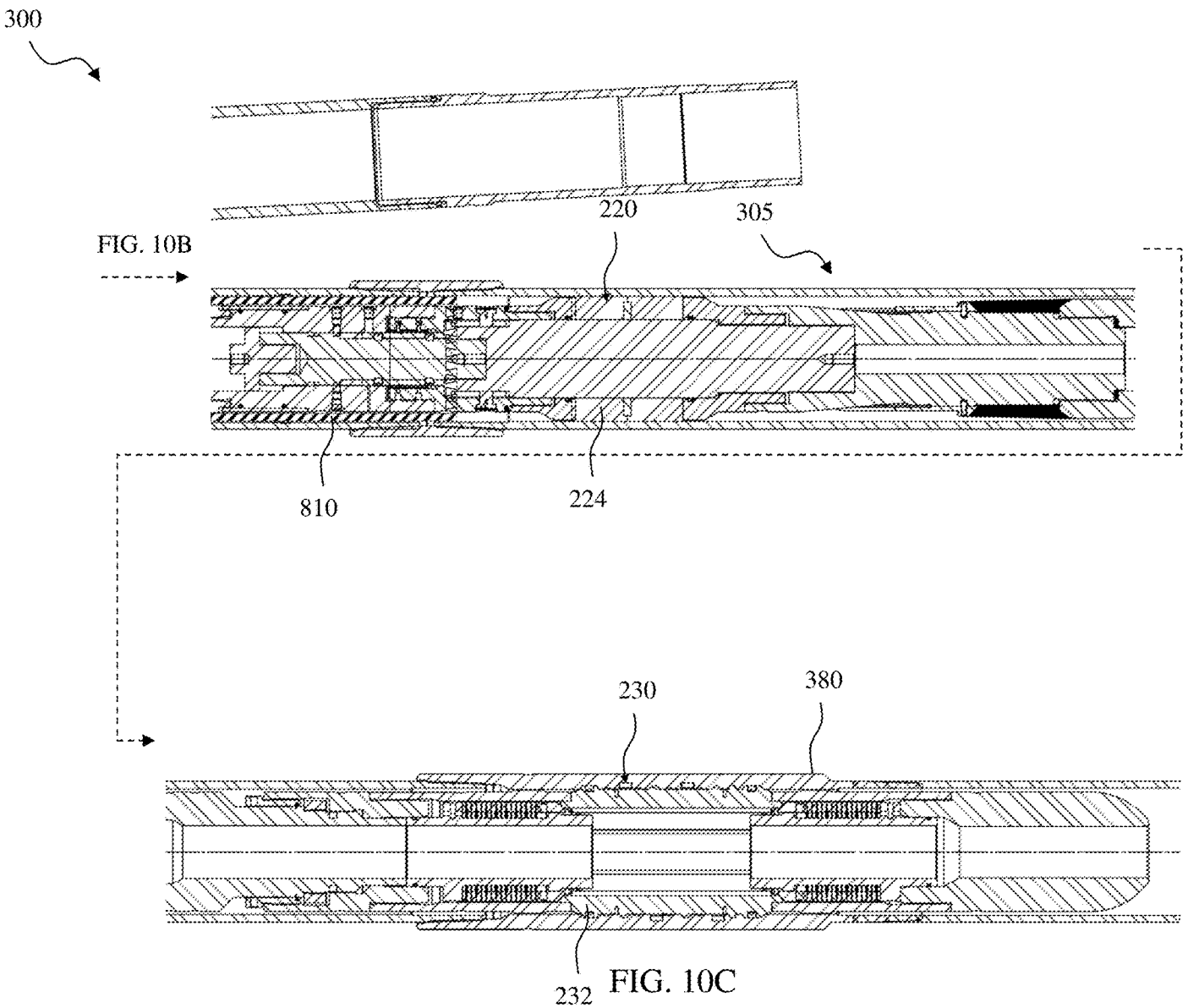
Figure 11A:
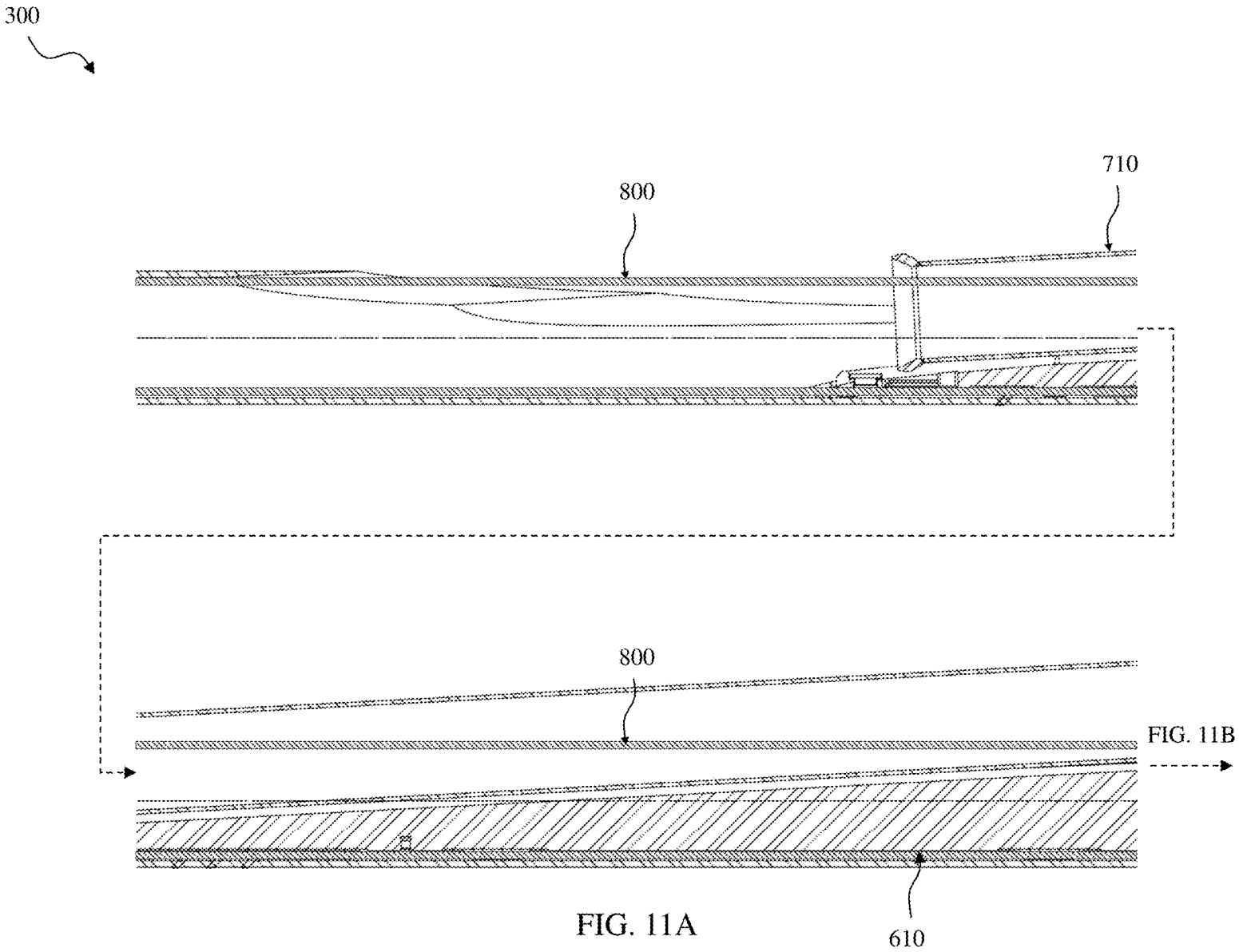
Figure 11B:
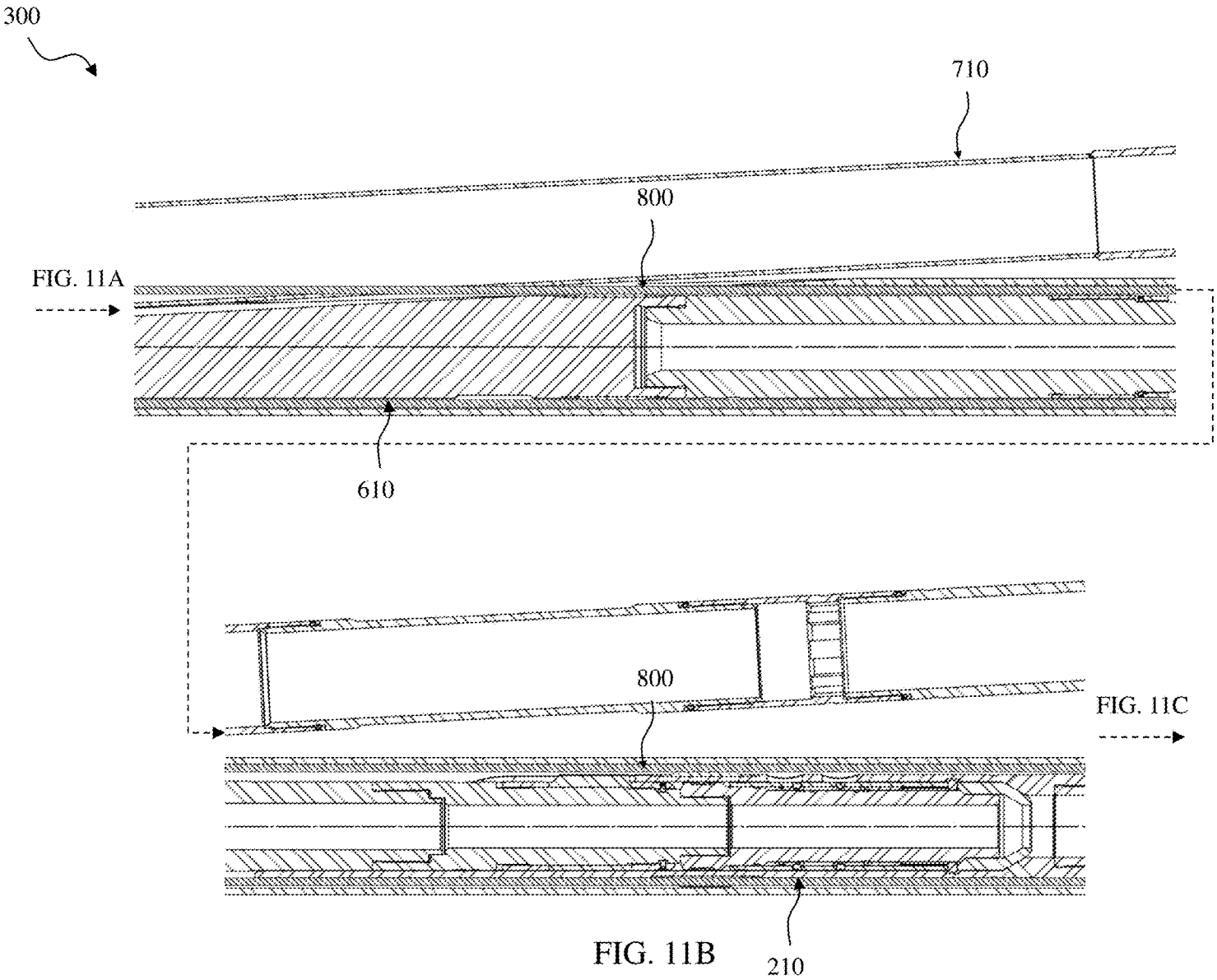
Figure 11C:
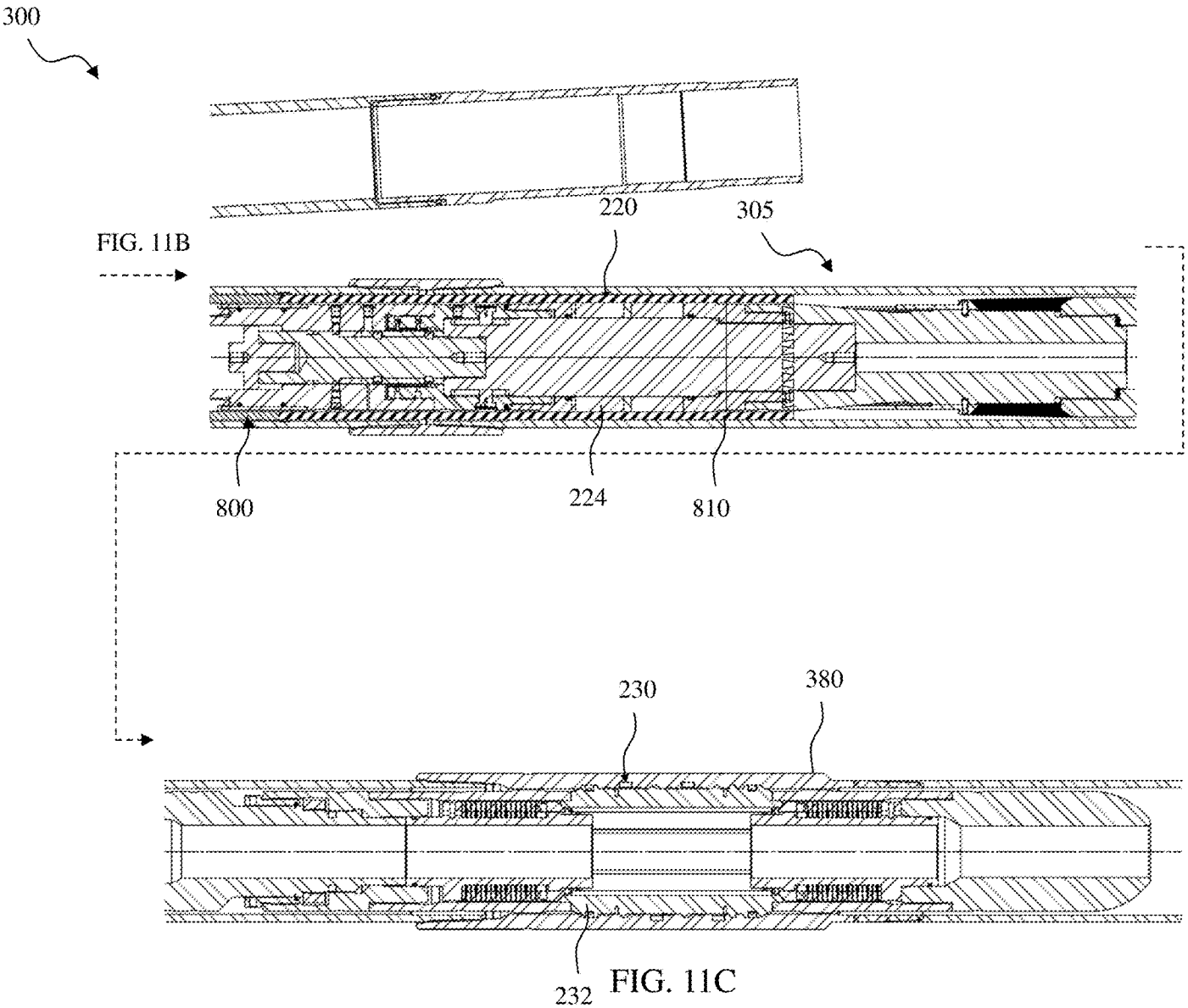
Figure 12A:
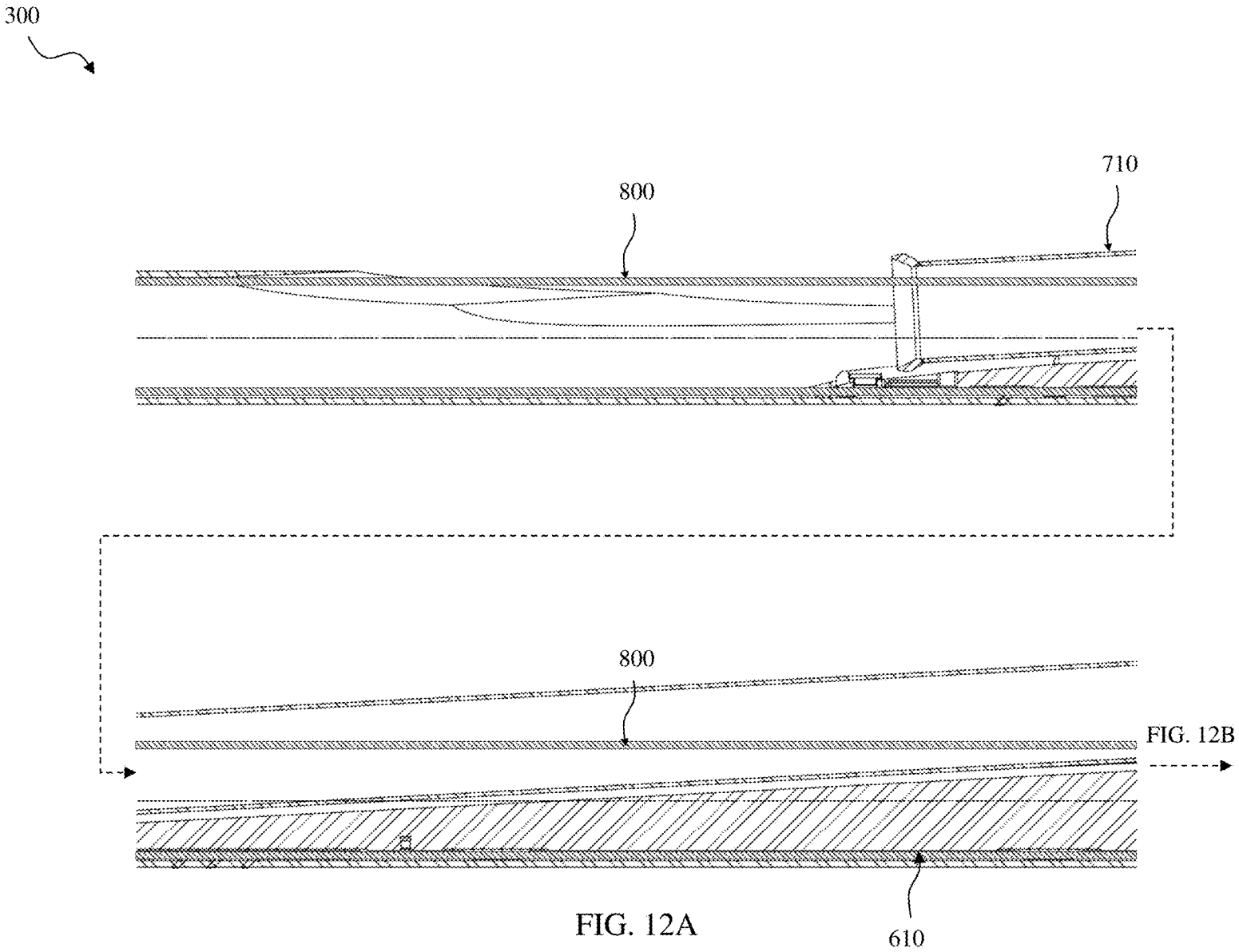
Figure 12B:
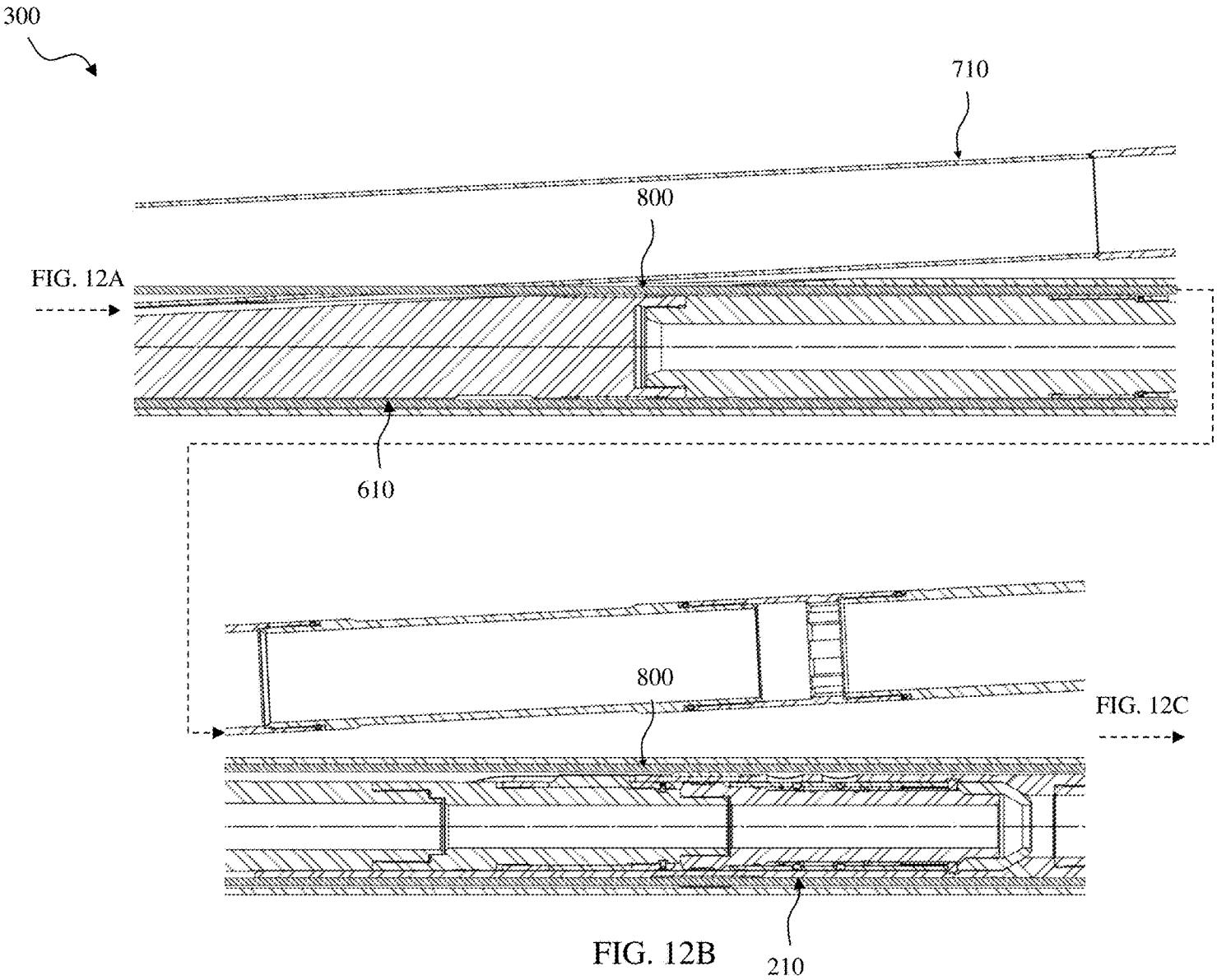
Figures 12B, 12C:
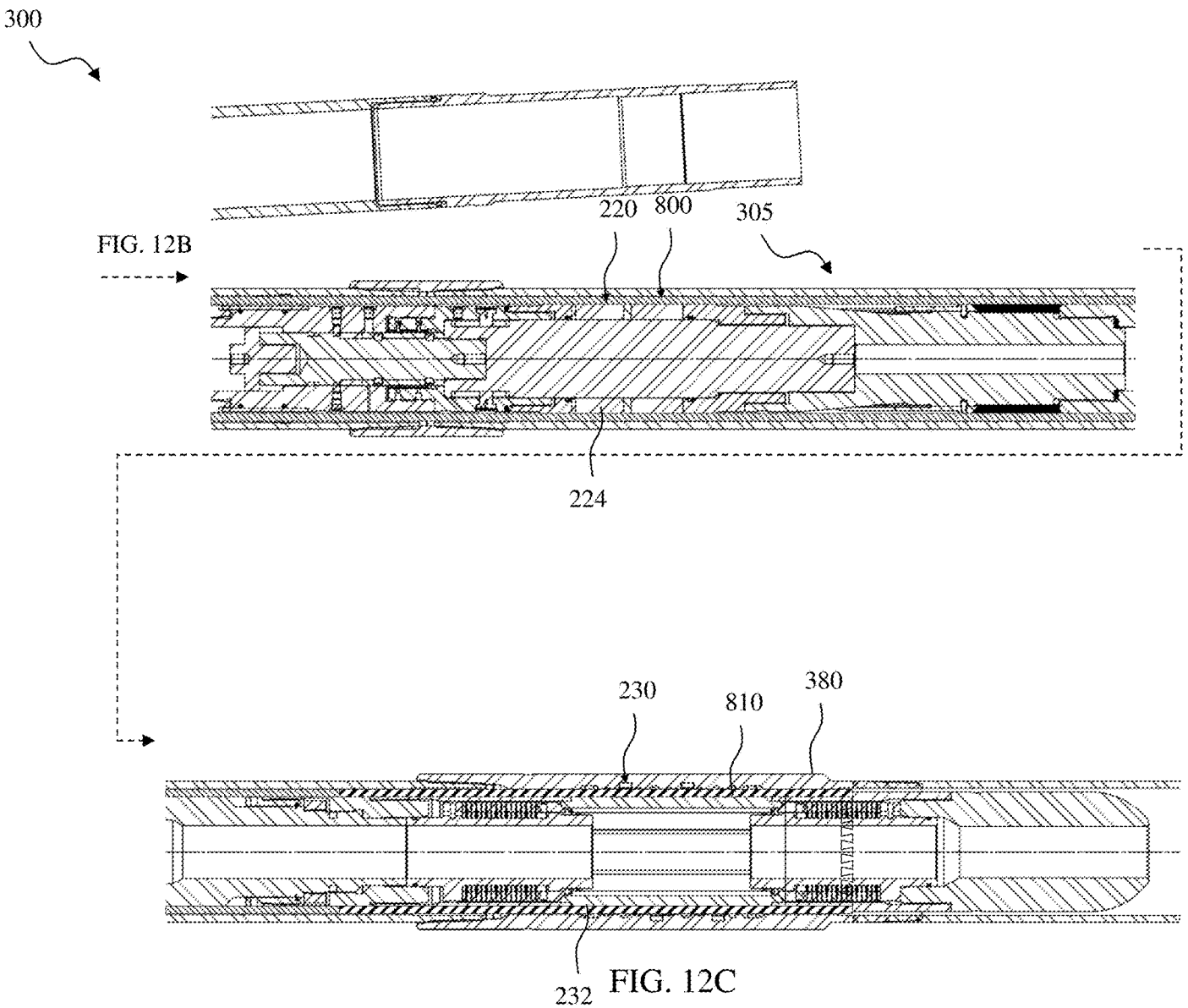

FIGS. 9A through 9C illustrate the washover assembly 800 as it is just about to encounter the transition joint 710. FIGS. 10A through 10C illustrate the washover assembly 800 approaching the sealing section 220, and FIGS. 11A through 11C illustrate the washover assembly 800 shearing the sealing section 220 and engaging with a profile in the whipstock assembly 300 for removal thereof. FIGS. 12A through 12C illustrate the washover assembly 800 shearing the latching feature 232 of the latching element section 230, for example if for one reason or another the latching feature 232 was unable to disengage.

Aspects disclosed herein include:

A. An anchoring subassembly, the anchoring subassembly including: 1) an orienting receptacle section; 2) a sealing section coupled proximate a downhole end of the orienting receptacle section; and 3) a latching element section coupled proximate a downhole end of the sealing section.

B. A well system, the well system including: 1) a main wellbore located within a subterranean formation; 2) a lateral wellbore extending from the main wellbore; 3) an anchoring subassembly positioned proximate an intersection between the main wellbore and the lateral wellbore, the anchoring subassembly including: a) an orienting receptacle section; b) a sealing section coupled proximate a downhole end of the orienting receptacle section; and c) a latching element section coupled proximate a downhole end of the sealing section.

C. A method for forming a well system, the method including: 1) forming a main wellbore within a subterranean formation; 2) positioning an anchoring subassembly within the main wellbore, the anchoring subassembly including: a) an orienting receptacle section; b) a sealing section coupled proximate a downhole end of the orienting receptacle section; and c) a latching element section coupled proximate a downhole end of the sealing section.

D. A method for forming a well system, the method including: 1) forming a wellbore within a subterranean formation; 2) positioning an anchoring subassembly within the wellbore; and 3) washing over at least a portion of the anchoring subassembly with a washover assembly, and then removing the washed over anchoring subassembly from the wellbore.

E. A method for forming a well system, the method including: 1) forming a main wellbore within a subterranean formation; 2) positioning a whipstock assembly within the mail wellbore, the whipstock assembly including an anchoring subassembly; 3) drilling a lateral wellbore from the main wellbore using the whipstock assembly; and 4) washing over at least a portion of the whipstock assembly with a washover assembly, and then removing the washed over whipstock assembly from the wellbore.

Aspects A, B, C, D, and E may have one or more of the following additional elements in combination: Element 1: wherein the sealing section includes a ratcheting mechanism configured to move an isolation element of the sealing section from a radially retracted state to a radially expanded state. Element 2: wherein the sealing section is coupled directly to the downhole end of the orienting receptacle section. Element 3: wherein the orienting receptacle section is coupled directly to the downhole end of the sealing section. Element 4: wherein the orienting receptacle section includes a muleshoe. Element 5: further including a whipstock element section coupleable proximate an uphole end of the orienting receptacle section. Element 6: wherein a collection of one or more collets and one or more orienting keys orient and couple the whipstock element section with the orienting receptacle section. Element 7: further including a whipstock element section coupled proximate an uphole end of the orienting receptacle section, the whipstock element section and the anchoring subassembly forming at least a portion of a whipstock assembly. Element 8: wherein positioning a whipstock within the main wellbore further includes latching the latching element section with a latch profile in wellbore casing located in the main wellbore. Element 9: wherein positioning the whipstock within the main wellbore further includes deploying a sealing element of the sealing section within the main wellbore after latching the latching element. Element 10: wherein deploying the sealing element includes actuating a ratcheting mechanism to move the isolation element of the sealing section from a radially retracted state to a radially expanded state. Element 11: further including coupling a whipstock element section with the orienting receptacle section after deploying the sealing element, and drilling a lateral wellbore from the main wellbore using the whipstock element section, the whipstock element section and the anchoring subassembly forming at least a portion of a whipstock assembly. Element 12: further including washing over the sealing element in the radially expanded state with a washover assembly and then removing the removing the whipstock assembly from the wellbore. Element 13: wherein washing over the at least a portion of the anchoring subassembly includes milling over and swallowing the at least a portion of the anchoring subassembly. Element 14: wherein the anchoring subassembly includes a sealing section having a sealing element positioned in a radially expanded state. Element 15: wherein milling over and swallowing the at least a portion of the anchoring subassembly includes milling over and swallowing the sealing element positioned in the radially expanded state. Element 16: wherein the anchoring subassembly further includes an orienting receptacle section located proximate an uphole end of the sealing section and a latching element section located proximate a downhole end of the sealing section. Element 17: wherein washing over the at least a portion of the anchoring subassembly includes milling over and swallowing the orienting receptacle section. Element 18: wherein positioning the anchoring subassembly within the wellbore further includes latching the latching element section with a latch profile in wellbore casing located in the wellbore. Element 19: wherein positioning the anchoring subassembly within the wellbore further includes deploying the sealing element of the sealing section within the wellbore after latching the latching element. Element 20: wherein deploying the sealing element includes actuating a ratcheting mechanism to move the isolation element of the sealing section from a radially retracted state to the radially expanded state. Element 21: further including coupling a whipstock element section with the orienting receptacle section after deploying the sealing element and before washing over the sealing element, and then drilling a lateral wellbore from the wellbore using the whipstock element section.

Those skilled in the art to which this application relates will appreciate that other and further additions, deletions, substitutions and modifications may be made to the described embodiments.

What is claimed is:

1. An anchoring subassembly, comprising:

an orienting receptacle sub, the orienting receptacle sub having an axial orientation slot configured to engage with an orientation feature of a related downhole tool to rotationally orient the related downhole tool as the orientation feature engages the axial orientation slot;

a sealing sub coupled proximate a downhole end of the orienting receptacle sub, the sealing sub including an axial compression mechanism and an isolation element, the axial compression mechanism configured to axially compress the isolation element from a radially retracted state to a radially expanded state, wherein the orienting receptacle sub is fixedly coupled with the sealing sub to remain downhole with the sealing sub, and further wherein a downhole end of the axial orientation slot is uphole of an uphole end of the sealing sub; and a latching element sub coupled proximate a downhole end of the sealing sub.

2. The anchoring subassembly as recited in claim 1, wherein the sealing sub includes a ratcheting mechanism configured to move the isolation element from the radially retracted state to the radially expanded state.

3. The anchoring subassembly as recited in claim 1, wherein the sealing sub is coupled directly to the downhole end of the orienting receptacle sub.

4. The anchoring subassembly as recited in claim 3, wherein the latching element sub is coupled directly to the downhole end of the sealing sub.

5. The anchoring subassembly as recited in claim 4, wherein the orienting receptacle sub includes a muleshoe including the axial orientation slot.

6. The anchoring subassembly as recited in claim 1, further including a whipstock element sub coupleable proximate an uphole end of the orienting receptacle sub.

7. The anchoring subassembly as recited in claim 6, wherein a collection of one or more collets and one or more orienting keys orient and couple the whipstock element sub with the orienting receptacle sub.

8. A well system, comprising:

a main wellbore located within a subterranean formation;

a lateral wellbore extending from the main wellbore;

an anchoring subassembly positioned proximate an intersection between the main wellbore and the lateral wellbore, the anchoring subassembly including:

an orienting receptacle sub, the orienting receptacle sub having an axial orientation slot configured to engage with an orientation feature of a related downhole tool to rotationally orient the related downhole tool as the orientation feature engages the axial orientation slot;

a sealing sub coupled proximate a downhole end of the orienting receptacle sub, the sealing sub including an axial compression mechanism and an isolation element, the axial compression mechanism configured axially compress the isolation element from a radially retracted state to a radially expanded state, wherein the orienting receptacle sub is fixedly coupled with the sealing sub to remain downhole with the sealing sub, and further wherein a downhole end of the axial orientation slot is uphole of an uphole end of the sealing sub; and a latching element sub coupled proximate a downhole end of the sealing sub.

9. The well system as recited in claim 8, wherein the sealing sub includes a ratcheting mechanism configured to move the isolation element from the radially retracted state to the radially expanded state.

10. The well system as recited in claim 8, wherein the sealing sub is coupled directly to the downhole end of the orienting receptacle sub.

11. The well system as recited in claim 10, wherein the latching element sub is coupled directly to the downhole end of the sealing sub.

12. The well system as recited in claim 11, wherein the orienting receptacle sub includes a muleshoe including the axial orientation slot.

13. The well system as recited in claim 8, further including a whipstock element sub coupled proximate an uphole end of the orienting receptacle sub, the whipstock element sub and the anchoring subassembly forming at least a portion of a whipstock assembly.

14. The well system as recited in claim 13, wherein a collection of one or more collets and one or more orienting keys orient and couple the whipstock element sub with the orienting receptacle sub.

15. A method for forming a well system, comprising:

forming a main wellbore within a subterranean formation;

positioning an anchoring subassembly within the main wellbore, the anchoring subassembly including:

an orienting receptacle sub, the orienting receptacle sub having an axial orientation slot configured to engage with an orientation feature of a related downhole tool to rotationally orient the related downhole tool as the orientation feature engages the axial orientation slot;

a sealing sub coupled proximate a downhole end of the orienting receptacle sub, the sealing sub including an axial compression mechanism and an isolation element, the axial compression mechanism configured axially compress the isolation element from a radially retracted state to a radially expanded state, wherein the orienting receptacle sub is fixedly coupled with the sealing sub to remain downhole with the sealing sub, and further wherein a downhole end of the axial orientation slot is uphole of an uphole end of the sealing sub; and a latching element sub coupled proximate a downhole end of the sealing sub.

16. The method as recited in claim 15, wherein positioning an anchoring subassembly within the main wellbore further includes latching the latching element sub with a latch profile in wellbore casing located in the main wellbore.

17. The method as recited in claim 16, wherein positioning the anchoring subassembly within the main wellbore further includes deploying a sealing element of the sealing sub within the main wellbore after latching the latching element.

18. The method as recited in claim 17, wherein the sealing sub includes a ratcheting mechanism configured to move the isolation element from the radially retracted state to the radially expanded state, and further wherein deploying the sealing element includes actuating the ratcheting mechanism.

19. The method as recited in claim 17, further including coupling a whipstock element sub with the orienting receptacle sub after deploying the sealing element, and drilling a lateral wellbore from the main wellbore using the whipstock element sub, the whipstock element sub and the anchoring subassembly forming at least a portion of a whipstock assembly.

20. The method as recited in claim 15, further including washing over the sealing element in the radially expanded state with a washover assembly and then removing the whipstock assembly from the wellbore.

* * * * *